US005169743A

United States Patent [19]

Ishikawa

[11] Patent Number: 5,169,743

[45] Date of Patent: Dec. 8, 1992

[54] METHOD OF PROCESSING SILVER HALIDE COLOR PHOTOGRAPHIC PHOTOSENSITIVE MATERIAL

[75] Inventor: Takatoshi Ishikawa, Minami-Ashigara, Japan

[73] Assignee: Fuji Photo Film Co., Ltd., Minami-Ashigara, Japan

[21] Appl. No.: 199,322

[22] Filed: May 26, 1988

[30] Foreign Application Priority Data

May 29, 1987 [JP] Japan ..... 62-134422

[51] Int. Cl.[5] ..... G03C 7/40; G03C 7/42

[52] U.S. Cl. ..... 430/372; 430/393; 430/428; 430/460

[58] Field of Search ..... 430/372, 393, 398, 428, 430/460

[56] References Cited

U.S. PATENT DOCUMENTS 4,576,909 3/1986 Goto et al. ..... 430/546
4,745,048 5/1988 Kishimoto et al. ..... 430/376
4,752,556 6/1988 Kishimoto ..... 430/398
4,789,626 12/1988 Sakanoue et al. ..... 430/372
4,804,616 2/1989 Ueda et al. ..... 430/400

FOREIGN PATENT DOCUMENTS 0136924 4/1985 European Pat. Off. .
0206049 12/1986 European Pat. Off. .
2165954 4/1986 United Kingdom .

*Primary Examiner*—Hoa Van Le
*Attorney, Agent, or Firm*—Burns, Doane, Swecker & Mathis

[57] ABSTRACT

A method for processing a silver halide color photographic photosensitive material which comprises subjecting an imagewise exposed silver halide color photographic photosensitive material to color development process followed by bleach-fixing process and water washing and/or stabilization process. This method is characterized in that pH of the bleach-fixing solution ranges from 3.5 to 5.5 and the amount of replenished liquid for washing water and/or stabilization solution is 3 to 50 times the volume of liquid carried over from the bath preceding the water washing and/or the stabilization bath.

6 Claims, No Drawings

METHOD OF PROCESSING SILVER HALIDE COLOR PHOTOGRAPHIC PHOTOSENSITIVE MATERIAL

BACKGROUND OF THE INVENTION

1. Field of the Invention

The present invention relates to a method of processing silver halide color photographic photosensitive material. In particular, the present invention provides a bleach-fixing solution having particularly excellent desilverizability and stability.

2. Description of the Prior Art

Recently in the processing of silver halide color photographic photosensitive materials, an excellent development finish, reduction of delivery time and reduction of environmental pollution have been eagerly demanded. Therefore, facilitation, acceleration and stabilization of the process and the reduction of environmental pollution are now importantproblems.

For the facilitation of the desilverization step, a bleach-fixing process wherein the bleaching and fixing are conducted at the same time is the most easy. In this process, ordinarily an iron/organic acid complex is used as an oxidant, a thiosulfate is used as a fixing agent and a sulfite is used as a preservative. However, it is well known that since the bleach-fixing solution comprises both oxidant and reducing agent, its oxidizing power is weaker than that of an ordinary bleaching solution and its stability is disadvantageously lower than that of the latter.

The bleach-fixing solution has, therefore, a low desilverization velocity and various techniques of accelerating the desilverization have been proposed. For example, the bleach-accelerating agents used in the techniques thus proposed heretofore include compounds having a mercapto group or disulfide group described in U.S. Pat. No. 3,893,858, West German Patent No. 1,290,812, Japanese Patent Unexamined Published Application (hereinafter referred to as "J.P. KOKAI") Nos. 53-32736 and 53-28426 and Research Disclousre No. 17129 (July, 1978); thiazolidine derivatives described in J.P. KOKAI No. 50-140129; thiourea derivatives described in J.P. KOKAI No. 53-32735 and U.S. Pat. No. 3,706,561; iodides described in J.P. KOKAI No. 58-16235; polyethylene oxides described in West German Patent No. 966,410; polyamine compounds described in Japanese Patent Publication for Opposition Purpose (hereinafter referred to as "J.P. KOKOKU") No. 45-8836; compounds described in J.P. KOKAI Nos. 49-42434 and 58-63940; and iodine and bromine, ions. However, no technique capable of sufficiently accelerating the desilverization has been developed yet. Although a technique of improving the oxidizing power of the bath by lowering pH of the bath is described in J.P. KOKAI No. 58-18632, the cyan dye is converted into a leuco dye and satisfactory results cannot be obtained, while an excellent bleaching power is obtained.

The stability of the bleach-fixing solution can be improved by, for example, a method wherein the amount of a sulfite ion used as the preservative is increased, a method wherein a reducing agent such as ascorbic acid is used or a method wherein pH of the bath is elevated to 7 or higher, particularly 8 or higher. However, in these methods, the silver bleaching power is reduced. Thus, both acceleration and stabilization could not be attained simultaneously.

Under these circumstances, no stable bleach-fixing bath having an excellent bleaching power has been developed yet.

On the other hand, techniques of remarkably saving water have been developed for the purpose of saving resources, reducing envinmental pollution and facilitating the process (i.e., to make pipes unnecessary) as described in J.P. KOKAI Nos. 56-70549, 57-132146, 57-8543, 58-18631, 59-184343, 59-184345 and 58-14834.

However, in the technique comprising the processing with the bleach-fixing solution followed by the above-mentioned water-saving processing, when the desilverization and subsequent steps are conducted rapidly in 3 min, the washing-out of the components of the color developer and those of the bleach-fixing solution becomes insufficient and, as a result, the stability of the image cannot be maintained for a long time. This problem is more serious when a highly active 2-equivalent coupler is used for the purpose of saving silver. Particularly a stain formation with tie after the processing is a serious problem.

Techniques for preventing the formation of the stain by incorporating a special component in the photosensitive material are described in J.P. KOKAI Nos. 49-11330, 50-57223, 56-85747 and 58-115438 and J.P. KOKOKU No. 56-8346. However, the effects of them are yet insufficient.

A technique for preventing the stain formation by processing with a buffering agent in a stabilizing, bath to control pH of the finished film to about 3 to 6.5 is well known and has been described in J.P. KOKAI No. 57-8543. In addition, a technique of lowering pH of the film with a stabilizing solution containing ammonium ion after the processing is described in J.P. KOKAI No. 60-135942. Such a technique of lowering pH of the film of the photosensitive material is yet unsatisfactory, since it reduces the stability of a yellow image, though it has some effect of preventing the stain formation.

SUMMARY OF THE INVENTION

Accordingly, an object of the present invention is to provide an easy, rapid processing method capable of attaining a high bleaching power and an excellent stability wherein a cyan dye is scarcely converted to a leuco dye.

Another object of the present invention is to provide an easy, rapid processing method capable of providing an excellent image stability.

The above-described objects can be attained by the following processing method:

a method for processing a silver halide color photographic photosensitive material which comprises subjecting an imagewise exposed silver halide color photographic photosensitive material to color development process followed by bleach-fixing process and water washing and/or stabilization process, the method being characterized in that the pH of the bleach-fixing solution ranges from 3.5 to 5.5 and the amount of replenished liquid for washing water and/or stabilization solution is 3 to 50 times the volume of liquid carried over from the bath preceding the water washing and/or the stabilization bath.

Usually the bleach-fixing solution is designed so that it has a neutral pH of 6 to 8, since its bleaching power is incompatible with its stability. It is known that the solution having pH 6 is unstabler than that having pH 8. The inventors have found that stability and bleaching power of the bath having a pH in the range of 3.5 to 5 are higher than those of that having a pH of 7. However, when the former bath is used, the cyan dye is easily converted into a leuco dye. Unexpectedly, this problem (conversion into a leuco dye) can be solved by the water-saving processing in which the quantity of water required in the subsequent bath(s) such as water washing bath and stabilization bath can be reduced remarkably. Another advantage is that the problem of the stain easily formed after the processing with a 2-equivalent type coupler is effectively solved.

DESCRIPTION OF THE PREFERRED EMBODIMENTS

The details of the processing of the present invention will be described. The processing in the present invention comprises a color development, bleach-fixing, water washing and/or stabilization steps. Typical examples thereof are as follows, which by no means limit the present invention.

1. Color development - bleaching-fixing - [water washing],
2. Color development - bleaching-fixing - [water washing], stabilization,
3. Color development - bleaching - bleach-fixing - [water washing].
4. Color development - bleaching - bleach-fixing - [water washing] - stabilization,
5. Color development - rinsing - bleach-fixing - [water washing].
6. Color development - fixing - bleach-fixing - [water washing] - stabilization.
7. Black and white development - water washing - color development - bleach-fixing - [water washing], and
8. Black and white development - water washing - color development - water washing - bleach-fixing - [water washing].

The above-mentioned step of

[water washing]

can be replaced with the stabilization step. The amount of water replenished is 3 to 50 times as much as that brought therein from a preceding bath.

The color developer used in the present invention comprises a known aromatic primary amine as the color developing agent. Preferred color developing agents are p-phenylenediamine derivatives. Typical examples of them include the following compounds:

D-1: N,N-diethyl-p-phenylenediamine,
D-2: 2-amino-5-diethylaminotoluene,
D-3: 2-amino-5-(N-ethyl-N-laurylamino)toluene,
D-4: 4-[N-ethyl-N-(β-hydroxyethyl)amino]aniline,
D-5: 2-methyl-4-[N-ethyl-N-(β-hydroxyethyl-)amino]aniline,
D-6: 4-amino-3-methyl-N-ethyl-N-[β-(methanesulfonamido)ethyl]-aniline,
D-7: N-(2-amino-5-diethylaminophenylethyl)methane sulfonamide,
D-8: N,N-dimethyl-p-phenylenediamine,
D-9: 4-amino-3-methyl-N-ethyl-N-methoxyethylaniline,
D-10: 4-amino-3-methyl-N-ethyl-N-β-ethoxyethylaniline, and
D-11: 4-amino-3-methyl-N-ethyl-N-β-butoxyethylaniline.

Among these p-phenylenediamine derivatives, particularly preferred is 4-amino-3-methyl-N-ethyl-N-[β-(methanesulfonamido)ethyl]-aniline (D-6).

The p-phenylenediamine derivatives may be in the form of their salts such as sulfates, hydrochlorides, sulfites and p-toluenesulfonates. The amount of the aromatic primary amine used as the developing agent is preferably about 0.1 to 20 g, particularly about 0.5 to 10 g per liter of the developer.

If necessary, a preservative may be incorporated in the color developer. The preservatives include sulfites such as sodium sulfite, potassium sulfite, sodium bisulfite, potassium bisulfite, sodium metasulfite and potassium metasulfite and carbonyl sulfuric acid adducts.

It is also preferred to add, to the developer, compounds for directly preserving the foregoing color developing agent such as various hydroxylamines; hydroxamic acids as disclosed in Japanese Patent Application Serial (hereunder referred to as J.P.A.) No. 61-186559 (J.P. KOKAI No. 63-43138); hydrazines and hydrazides as disclosed in J.P.A. No. 61-170756 (EP-A-254280, US Serial No. 76505); phenols as disclosed in J.P.A. Nos. 61-188742 (J.P. KOKAI No. 63-44657) and 61-203253; alpha-hydroxy-ketones and alpha-aminoketones as disclosed in J.P.A. No. 61-188741 (J.P. KOKAI 63-44656); and/or various sugars as disclosed in J.P.A. No. 61-180616 (J.P. KOKAI No. 63 36244). In addition, it is preferable to simultaneously add, thereto, monoamines as disclosed in J.P.A. No. 61-147823 (J.P. KOKAI No. 63-4235), 61-166674 (J.P. KOKAI No. 63-24254), 61-165621 (J.P. KOKAI No. 63-21647), 61-164515 (U.S. Ser. No. 72479), 61-170789 (J.P. KOKAI No. 63-27841) and 61-168159 (J.P. KOKAI No. 63-25654); diamines as disclosed in J.P.A. Nos. 61-173595 (J.P. KOKAI No. 63-30845), 61-164515 (U.S. Ser. No. 72479) and 61-186560 (J.P. KOKAI No. 63-43139); polyamines as disclosed in J.P.A. Nos. 61-165621 (J.P. KOKAI No. 63-21647), 61-169789 (J.P. KOKAI No. 63-26655) and 61-188619 (J.P. KOKAI No. 63-44655); nitroxy radicals as disclosed in J.P.A. No. 61-197760 (J.P. KOKAI No. 63-53551); alcohols as disclosed in J.P.A. Nos. 61-186561 (J.P. KOKAI No. 63-43140) and 61-197419 (J.P. KOKAI No. 63-53349); oximes as disclosed in J.P.A. No. 61-198987 (J.P. KOKAI No. 53-56654); and tertiary amines as disclosed in J.P.A. No. 61-265149 (U.S. Ser. No. 117727).

If necessary, preservatives may be used. They include, for example, metals described in J.P. KOKAI Nos. 57-44148 and 57-53749; salicylic acids described in J.P. KOKAI No. 59-180588; alkanolamines described in J.P. KOKAI No. 54-3532; polyethyleneimines described in J.P. KOKAI No. 56-94349; and aromatic polyhydroxy compounds described in U.S. Pat. No. 3,746,544. Among them, the aromatic polyhydroxy compounds are preferred.

The pH of the color developer used in the present invention is in the range of 9 to 12, particularly 9 to 11.0. The color developer may contain other compounds known as additives for developers.

To keep the pH in the above-mentioned range, a buffering agent is preferably used. The buffering agents include, for example, sodium carbonate, potassium carbonate, sodium hydrogencarbonate, potassium hydrogencarbonate, trisodium phosphate, tripotassium phosphate, disodium phosphate, dipotassium phosphate, sodium borate, potassium borate, sodium tetraborate (borax), potassium tetraborate, sodium o-hydroxybenzoate (sodium salicylate), potassium o-hydroxybenzoate, sodium 5-sulfo-2-hydroxybenzoate (sodium 5-sulfosalicylate) and potassium 5-sulfo-2-hydroxybenzoate (potassium 5-sulfosalicylate). The buffering agents usable in the present invention are, however, not limited to them.

The amount of the buffering agent to be added to the color developer is preferably at least 0.1 mol/l, particularly in the range of 0.1 to 0.4 mol/l.

The color developer can contain further various chelating agents in order to prevent the precipitation of calcium or magnesium or to improve the stability of the developer.

The chelating agents include, for example, nitrilotriacetic acid, diethylenetriaminepentaacetic acid, ethylenediaminetetraacetic acid, N,N,N-trimethylenephosphonic acid, ethylenediamine-N,N,N',N'-tetramethylenephosphonic acid, transcyclohexanediamine tetraacetate, 1,2-diaminopropanetetraacetic acid, glycol ether diamine tetraacetate, ethylenediamine o-hydroxyphenylaceaate, 2-phosphonobutane-1,2,4-tricarboxylic acid, 1-hydroxyethylidene-1,1-diphosphonic acid and N,N'-bis(2-hydroxybenzyl)ethylenediamine-N,N'-diacetic acid.

These chelating agents can be used either singly or as a combination of two or more kinds thereof.

The chelating agent is used in an amount sufficient for sequestering the metal ion in the color developer. The amount is, for example, about 0.1 to 10 g per liter of the color developer.

If necessary, a development accelerator can be added to the color developer.

The above-mentioned compounds used in the present invention exhibit excellent effects particularly when the color coupler contains substantially no benzyl alcohol.

The development accelerators include, for example, thioether compounds described in J.P. KOKOKU Nos. 37-16088, 37-5987, 38-7826, 44-12380 and 45-9019 and U.S. Pat. No. 3,813,247; p-phenylenediamine compounds described in J.P. KOKAI Nos. 52-49829 and 50-15554; quaternary ammonium salts described in J.P. KOKAI No. 50-137726, J.P. KOKOKU No. 44-30074 and J.P. KOKAI Nos. 56-156826 and 52-43429; amine compounds described in U.S. Pat. Nos. 2,494,903, 3,128,182, 4,230,796 and 3,253,919, J.P. KOKOKU No. 41-11431 and U.S. Pat. Nos. 2,482,546, 2,596,926 and 3,582,346; polyalkylene oxides described in J.P. KOKOKU Nos. 37-16088 and 42-25201, U.S. Pat. No. 3,128,183, J.P. KOKOKU Nos. 41-11431 and 42-23883 and U.S. Pat. No. 3,532,501; and 1-phenyl-3-pyrazolidones and imidazoles.

An antifoggant can be used, if necessary, in the present invention. The antifoggants include alkali metal halides such as sodium chloride, potassium bromide and potassium iodide and organic antifoggants. Typical examples of the organic antifoggants include nitrogen-containing heterocyclic compounds such as benzotriazole, 6-nitrobenzimidazole, 5-nitroisoindazole, 5-methylbenzotriazole, 5-nitrobenzotriazole, 5-chlorobenzotriazole, 2-thiazolylbenzimidazole, 2-thiazolylmethylbenzimidazole, indazole, hydroxyazaindolizine and adenine.

The color developer used in the present invention preferably contains a fluorescent brightening agent such as preferably a 4,4'-diamino-2,2'-disulfostilbene compound. It is used in an amount of 0 to 5 g/l, preferably 0.1 to 4 g/l.

If necessary, a surfactant such as an alkylsulfonic acid, arylphosphonic acid, aliphatic carboxylic acid or aromatic carboxylic acid can be incorporated therein.

The color developer of the present invention is used at a temperature of 20° to 50° C., preferably 30° to 40° C. The processing time is 20 sec to 5 min, preferably 30 sec to 2 min. The smaller the replenisher, the better. The amount of the color developer replenished is 20 to 600 ml, preferably 50 to 300 ml and particularly 20 to 200 ml per square meter of the photosensitive material. In the present invention, when the processing is continuously carried out by replenishing a lower amount (30 to 150 ml/m$^2$) of the color developer, the advantages of the present invention can be effectively obtained.

The bleach-fixing solution is used in the desilverization step in the present invention. The shorter the time of the desilverization step, the more remarkable the effect of the present invention. The desilverization time is 6 min or shorter, preferably 30 sec to 4 min and particularly 30 to 60 sec.

The bleaching agents contained in the bleach-fixing solution used in the present invention include organic complex salts of iron, cobalt, nickel, manganese or chromium. Particularly preferred are iron (III)/organic acid complex salts such as iron (III) complex salts of aminopolycarboxylic acids, e.g. ethylenediaminetetraacetic acid and diethylenetriaminepentaacetic acid, aminopolyphosphonic acids, phosphonocarboxylic acids and organophosphonic acids, and organic acids such as citric acid, tartaric acid and malic acid.

Among them, the iron (III)/aminopolycarboxylic acid complex salts are particularly preferred from the viewpoints of the acceleration of the process and prevention of environmental pollution. The aminopolycarboxylic acids useful for forming the organic complex salts include, for example, ethylenediaminetetraacetic acid, diethylenetriaminepentaacetic acid, 1,3-diaminopropanetetraacetic acid, propylenediaminetetraacetic acid, nitrilotriacetic acid, cyclohexanediaminetetraacetic acid, methyliminodiacetic acid, imidodiacetic acid and glycol ether diaminetetraacetic acid.

These compounds can be in the form of sodium, potassium, lithium or ammonium salts of them. Among them, iron (III) complex salts of ethylenediaminetetraacetic acid, diethylenetriaminepentaacetic acid, cyclohexanediaminetetraacetic acid 1,3-diaminopropanetetraacetic acid and methyliminodiacetic acid are preferred, since they have a high bleaching power.

These ferric ion complex salts can be used as they are or the ferric ion complex salt can be formed in situ in the solution from a ferric salt such as ferric sulfate, ferric chloride, ferric ammonium sulfate or ferric phosphate with an aminopolycarboxylic acid chelating agent. The chelating agent can be used in an amount larger than that necessitated for forming the ferric ion complex salt. The amount is 0.01 to 1.0 mol/l, preferably 0.05 to 0.50 mol/l. The bleach-fixing solution and/or preceding baths can contain various bleaching accelerators. They include, for example, compounds having a mercapto group or disulfido bond described in U.S. Pat. No. 3,893,858, German Patent No. 1,290,812, J.P. KOKAI No. 53-95630 and Research Disclosure No. 17129 (July, 1978); thiourea compounds described in J.P. KOKOKU No. 45-8506, J.P. KOKAI Nos. 52-20832 and 53-32735 and U.S. Pat. No. 3,706,561; and halides such as iodides and bromides. They are preferred, since they have a high bleaching power.

The bleach-fixing solution used in the present invention can contain a rehalogenating agent such as a bromide (e.g. potassium bromide, sodium bromide or ammonium bromide), chloride (e.g. potassium chloride, sodium chloride or ammonium chloride) or iodide (e.g. ammonium iodide). If necessary, the bleach-fixing solution can contain one or more inorganic acids, organic acids and/or alkali metal salts or ammonium salts of them having a pH buffering function such as boric acid, borax, sodium metaborate, acetic acid, sodium acetate, sodium carbonate, potassium carbonate, phosphorous acid, phosphoric acid, sodium phosphate, citric acid, sodium citrate and tartaric acid; and a corrosion inhibitor such as an ammonium nitrate or guanidine.

The fixing agent contained in the bleach-fixing solution of the present invention is preferably a known one such as a thiosulfate, e.g. sodium thiosulfate or ammonium thiosulfate. Further, a special bleach-fixing solution comprising a combination of a fixing agent described in J.P. KOKAI No. 55-155354 and a large amount of a halide such as potassium iodide can also be used. The amount of the fixing agent is preferably 0.3 to 2 mol, particularly 0.5 to 1.0 mol, per liter of the solution.

The pH of the bleach-fixing solution of the present invention is in the range of 3.5 to 5.5, preferably 4 to 5. It is preferred to control pH of a running solution of the bleach-fixing solution within the above range. pH of the bleach-fixing solution to be replenished preferably ranges from 2 to 5. To adjust the pH, various organic and inorganic acids and based as well as buffering agents can be used. The acids include, for example, hydrochloric acid, sulfuric acid, nitric acid, phosphoric acid, acetic acid, propionic acid and citric acid. The alkal is include, for example, sodium hydroxide, potassium hydroxide, aqueous ammonia and amines. When the pH is higher than this range, the desilverizability and image stability are reduced and when it is lower than this range, the stability of the solution is reduced and the cyan dye is converted into a leuco dye seriously.

The bleach-fixing solution can contain further various fluorescent brightening agents, antifoaming agents, surfactants, and organic solvents such as polyvinyl pyrrolidone and methanol.

The bleach-fixing solution and fixing solution used in the present invention contain a preservative. The preservatives include sulfite ion-releasing compounds, for example, sulfites (such as sodium sulfite, potassium sulfite and ammonium sulfite), hydrogensulfites (such as ammonium hydrogensulfite, sodium hydrogensulfite and potassium hydrogensulfite) and metahydrogensulfites (such as potassium metahydrogensulfite, sodium metahydrogensulfite and ammonium metahydrogensulfite). The amount of these compounds is preferably 0.02 to 0.50 mol/l, particularly 0.04 to 0.40 mol/l, in terms of sulfite ion.

Sulfites are usually used as the preservatives. Further, ascorbic acid, carbonylbisulfite adducts and carbonyl compounds are also usable.

If necessary, the bleach-fixing solution and fixing solution may further contain a fluorescent brightening agent, chelating agent, antifoaming agent and antifungal agent.

In the step(s) of water washing and/or stabilization in the present invention, the amount of the replenisher is limited to 3 to 50 times, preferably 5 to 30 times, as much as the solution brought therein from the preceding bath. The amount of the solution brought therein from the preceding bath varies depending on the physical properties of the film of the photosensitive material, strength of the squeegee and processing velocity and is practically about 20 to 100 ml/m$^2$. A multi-stage counter-current method is preferably employed in order to reduce the amount of the replenisher in the step of water washing and/or stabilization step in the present invention. Particularly, 2 to 6-stage counter-current method is preferred. In such a case, the amount of the replenisher is particularly preferably about 50 to 500 ml per square meter of the photosensitive material.

Although the effect of the present invention can be exhibited remarkably according to the multi-stage counter-current method, bacteria propagate as the residence time of water in the tank is prolonged and, as a result, a suspended matter thus formed adheres to the photosensitive material. In processing the color photosensitive material according to the present invention, this problem can be solved quite effectively by a method described in J.P.A. No. 61-131632 (J.P. KOKAI No. 62-288838) for reducing the amount of calcium and magnesium. Further bactericides usable herein include, for example, isothiazolone compounds and thiabendazoles described in J.P. KOKAI No. 57-8542; chlorine-containing bactericides such as sodium isocyanurate chloride described in J.P. KOKAI No. 61-120145; benzotriazole described in J.P.A. No. 60-105487 (J.P. KOKAI No. 61-267761); copper ion; and bactericides described in Hiroshi Horiguchi, "Bokin Bobai-Zai no Kagaku" (Chemistry for Prevention of Bacteria and Fungi), "Biseibutsu no Mekkin, Sakkin, Bobai Gijutsu" edited by Eisei Gijutsu-kai and "Bokin Bokai-Zai Jiten" edited by Nippon Bokin Bobai Gakkai.

Water used for washing can contain a surfactant as a draining agent or a chelating agent such as EDTA as a softening agent for hard water.

The photosensitive material can be processed with a stabilizing solution directly or after the above-described step of water washing. The stabilizing solution contains a compound having an image-stabilizing effect such as an aldehyde compound, e.g. formalin; a buffering agent for controlling pH suitably for the stabilization of the dye; and an ammonium compound. Further, the above-described bactericides and antifungal agents can be used for preventing the propagation of bacteria in the solution or for making the processed photosensitive material antifungal.

Further, a surfactant fluorescent brightening agent and hardener can be added to the stabilizing solution. When the photosensitive material is directly processed omitting the step of water washing in the present invention, any of known methods described in J.P. KOKAI Nos. 57-8543, 58-14834 and 60-220345 can be employed.

It is also preferred to use a chelating agent such as 1-hydroxyethylidene-1,1-diphosphonic acid or ethylenediaminetetramethylenephosphonic acid, or a magnesium or bismuth compound.

In the step of water washing or stabilization step according to the present invention, the pH is controlled to 4 to 10, preferably 5 to 8. The temperature which varies depending on the use and properties of the photosensitive material is usually 15° to 45° C., preferably 20° to 40° C. The processing time can be selected suitably. The shorter the time, the more excellent the effect of the present invention. Preferably, the processing time is 30 sec to 4 min and particularly 30 sec to 2 min. The smaller the amount of the replenisher, the more remarkable the effect of the present invention with respect to the running cost, reduction of the amount of the discharge and easiness of handling.

When the total processing time in the bleach-fixing step and step of water washing, or in the bleach-fixing step, step of washing with water and stabilization step is 3 min or shorter, the effect of the present invention is particularly remarkable. A preferred time distribution comprises 30 to 60 sec for the bleach-fixing step and 30 to 90 sec for the step of water washing and/or stabilization step. The term "total processing time" herein indicates a time required after the photosensitive material is brought into contact with the bleach-fixing solution until it leaves the final bath for water washing or stabilization bath.

The water used for washing or stabilizing solution used the stabilization can be returned into a preceding step. For example, an overflow of water used for washing which is reduced in amount by the multi-stage counter-current method is circulated into the preceding bleach-fixing bath and a concentrated replenisher is supplied therein to reduce the amount of the waste to be discharged.

The photographic photosensitive material of the present invnention may contain a color image-forming coupler, i.e. a compound capable of coloring by the oxidation coupling with an aromatic primary amine developing agent (such as a phenylenediamine derivative or aminophenol derivative) in the color development processing. The couplers are preferably those of non-diffusion type having a hydrophobic group called 'ballast group' in the molecule or polymerized ones. The coupler may be either 4-equivalent or 2-equivalent to the silver ion. Further it may contain a colored coupler having a color compensating effect or a development inhibitor-releasing coupler (so-called DIR coupler) in the development step. The coupling reaction product may contain a colorless DIR coupling compound which releases the development inihibitor.

Magenta couplers include, for example, 5-pyrazolone coupler, pyrazolobenzimidazole coupler, cyanoacetylcoumarone coupler and ring-opened acylacetonitrile couplers. Yellow couplers include, for example, acylacetamide couplers (such as benzoylacetanilides and pivaloylacetanilides). Cyan couplers include naphthol couplers and phenol couplers.

The details of these couplers are described in Resarch Disclosure, Vol. 176, No. 17643 (December, 1978), VII and patents referred to therein.

The couplers for the photosensitive materials are preferably 2-equivalent couplers from the viepoint of saving silver. It is preferred that one or preferably two or more of the magenta, cyan and yellow couplers are made 2-equivalent.

According to the processing method of the present invention, the stain formation caused just after processing and/or with time when such a coupler is used can also be effectively inhibited.

As the 2-equivalent coupelrs, those of the following general formulae (I) to (IV) are preferred from the viewpoints of saving silver, color reproducibility, activity and storability. The method of the present invention is also quite effective inhibiting the stain formation caused by these couplers.

Cyan coupler

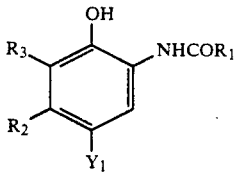

General formula (I)

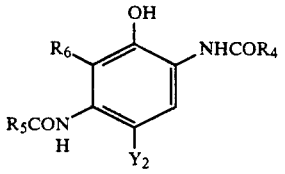

General formula (II)

Magenta coupler

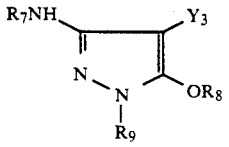

General formula (III)

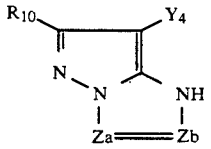

General formula (IV)

Yellow coupler

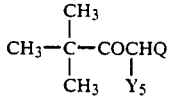

General formula (V)

wherein $R_1$, $R_4$ and $R_5$ each represent an aliphatic, group, aromatic group, heterocyclic group, aromatic amino group or heterocyclic amino group, $R_2$ represents an aliphatic group having 2 or more carbon atoms, $R_3$ and $R_6$ each represent a hydrogen atom, halogen atom, aliphatic group, aliphatic oxy group or acylamino group, $R_7$ and $R_9$ each represent a substituted or unsubstituted phenyl group, $R_8$ represents a hydrogen atom, aliphatic or aromatic acyl group or aliphatic or aromatic sulfonyl group, $R_{10}$ represents a hydrogen atom or substituent, Q represents a substituted or unsubstituted N-phenylcarbamoyl group, Za and Zb each represent a methine, substituted methine or =N—, and $Y_1$, $Y_2$, $Y_3$, $Y_4$ and $Y_5$ each represent a halogen atom or a group split off in the coupling reaction with the developing agent (hereinafter referred to as coupling-off group), $R_2$ and $R_3$, or $R_5$ and $R_6$ in the general formulae (I) and (II) may form bonded together to form a 5-, 6- or 7-membered ring, $R_1$, $R_2$, $R_3$ or $Y_1$; $R_4$, $R_5$, $R_6$ or $Y_2$; $R_7$, $R_8$, $R_9$ or $Y_3$; $R_{10}$, Za, Zb or $Y_4$; Q or $Y_5$ may form a dimer or a polymer, and the term 'aliphatic group' herein indicates a straight chain, branched or cyclic alkyl, alkenyl or a alkynyl group.

The detailed description will be made on $R_1$ to $R_{10}$, $Y_1$to $Y_5$, Za, Zb and Q in the above general formulae (I), (II), (III), (IV) and (V).

The coupling-off groups $Y_1$, $Y_2$, $Y_3$, $Y_4$ and $Y_5$ in the general formulae (I), (II), (III), (IV) and (V) are each (i) a group which bonds a coupling active carbon with an aliphatic group, aromatic group, heterocyclic group, aliphatic, aromatic or heterocyclic sulfonyl group or aliphatic, aromatic or heterocyclic carbonyl group through an oxygen, nitrogen, sulfur or carbon atom, (ii) a halogen atom or (iii) an aromatic azo group. The aliphatic, aromatic or heterocyclic group in these coupling-off groups can be substituted with a substituent selected from the group consisting of substituents of $R_1$ which will be described below. When the coupling-off group is substituted with two or more substituents, they may be either the same or different from each other and they may have further substituent(s) selected from the group consisting of the substituents of $R_1$.

The coupling-off groups include, for example, halogen atoms, alkoxy groups, aryloxy groups, acyloxy groups, aliphatic or aromatic sulfonyloxy groups, acylamino groups, aliphatic or aromatic sulfonamido groups, alkoxycarbonyloxy groups, aryloxycarbonyloxy groups, aliphatic aromatic or heterocyclic thio groups, carbamoylamino group, nitrogen-containing heterocyclic rings having 5 or 6 members, imido groups and aromatic azo groups. They may be substituted further with substituent(s) selectd from the group consisting of the substituents of $R_1$. The coupling-off groups bonded through a carbon atom include bis-type couplers prepared by condensing a tetravalent coupler with an aldehyde or ketone. The aplit-off groups of the present invention may have a photographically effective group such as a development-inhibiting group or development-accelerating group. Preferred combinations of the coupling-off groups in each general formula will be described hereinafter.

$R_1$, $R_4$ and $R_5$ in the general formulae (I) and (II) each represent preferably an aliphatic group having 1 to 36 carbon atoms, aromatic group having 6 to 36 carbon atoms (such as phenyl group or naphthyl group), heterocyclic group (such as 3-pyridyl group or 2-furyl group), or aromatic or heterocyclic amino group (such as anilino group, naphthylamino group, 2-benzothiazolylamino group or 2-pyridylamino group). These groups may be further substituted with an alkyl group, aryl group, heterocyclic group, alkoxyl group, aryloxy group, alkenyloxy group, acyl group, ester group (such as butoxycarbonyl group or phenoxycarbonyl group), amido group (such as acetylamino or ethylcarbamoyl group), sulfamido group (such as dipropylsulfamoylamino group), imido group (such as succinimido or hydantoinyl group), ureido group (such as phenylureido or dimethylureido group), aliphatic or aromatic sulfonyl group (such as methanesulfonyl or phenylsulfonyl group), aliphatic or aromatic thio group (such as ethylthio or phenylthio group), hydroxyl group, cyano group, carboxyl group, nitro group, sulfo group or halogen atom.

The term "aliphatic groups" herein indicates a straight chain, branched or cyclic aliphatic hydrocarbon groups including, for example, saturated and unsaturated alkyl alkenyl and alkynyl groups. Typical examples of them include methyl, ethyl, butyl, dodecyl, octadecyl, eicosenyl, isopropyl, tert-butyl, tert-octyl, tert-dodecyl, cyclohexyl, cyclopentyl, allyl, vinyl, 2-hexadecenyl and propargyl groups.

$R_2$ in the general formula (I) represents preferably an aliphatic group having 2 to 20 carbon atoms which may be substituted with a substituent selected from the group consisting of the substituents of $R_1$.

$R_3$ and $R_6$ in the general formulae (I) and (II) each represent a hydrogen atom, a halogen atom, preferably an aliphatic group having 1 to 20 carbon atoms, preferably an aliphatic oxy group having 1 to 20 carbon atoms or an acylamino group having 1 to 20 carbon atoms (such as acetamido group). These aliphatic groups, aliphatic oxy groups and acylamino groups may be substituted with a substituent selected from the group consisting of the substituents of $R_1$.

In the general formula (I), $R_2$ and $R_3$ may be bonded together to form a five-membered to seven-membered ring.

In the general formual (II), $R_5$ and $R_6$ may be bonded together to form a five-membered to seven-membered ring.

The coupler of the general formula (I) may form a dimer coupler or a higher polymer coupler by homopolymerization or copolymerization through any of groups $R_1$, $R_2$, $R_3$ and $Z_1$. Also the coupler of the general formula (II) may form a dimer coupler or higher polymer coupler through any of groups $R_4$, $R_5$, $R_6$ and Z2. When the coupler is the dimer, the group acts as a mere bond or as a divalent connecting group (such as an alkylene group, arylene group or a divalent group comprising a combination of them). When the coupler is an oligomer or polymer, the group preferably constitutes the main chain of the oligomer or polymer or it is preferably bonded to the main chain of the polymer through the above-mentioned divalent connecting group.

$R_1$ in the general formula (I) and $R_5$ in the general formula (II) are each preferably a substituted or unsubstituted alkyl or aryl group. The substituents of the alkyl group are particularly preferably substituted or unsubstituted phenoxy groups and halogen atoms (the substituents of the phenoxy group being preferably alkyl groups, alkoxy groups, halogen atoms, sulfonamido groups and sulfamido group). Particularly preferred aryl group is a phenyl group substituted with at least one halogen atom, alkyl group, sulfonamido group or acylamino group.

$R_4$ in the general formula (II) is preferably a substituted alkyl group or a substituted or unsubstituted aryl group. Particularly preferred substituent of the alkyl group is a halogen atom and particularly preferred aryl group is a phenyl group unsubstituted or substituted with at least one halogen atom or sulfonamido group.

$R_2$ in the general formula (I) is preferably a substituted or unsubstituted alkyl group having 1 to 20 carbon atoms. The substituents of $R_2$ are preferably alkyloxy, aryloxy, acylamino, alkylthio, arylthio, imido, ureido, alkylsulfonyl and arylsulfonyl groups.

$R_3$ in the general formula (I) is preferably a hydrogen atom, halogen atom (particularly fluorine or chlorine atom) or acylamino group. Among them, the halogen atom is particularly preferred.

$R_6$ in the general formula (II) is preferably a hydrogen atom or alkyl or alkenyl group having 1 to 20 carbon atoms. Among them, hydrogen atom is particularly preferred.

Preferably $R_5$ and $R_6$ in the general formula (II) are bonded together to form a 5 or 6-membered nitrogen-containing heterocyclic ring.

It is further preferred that $R_2$ in the general formula (I) is an alkyl group having 2 to 4 carbon atoms.

$Y_1$ and $Y_2$ in the general formulae (I) and (II) are preferably each a halogen atom, particularly chlorine atom.

The couplers of the general formulae (I) and (II) can be used either alone or in the form of a mixture of two or more of them.

It is well known in the art that when $R_8$ in the general formula (III) of the magenta coupler is a hydrogen atom, it comprises keto-enol tautomers.

The substituents of $R_9$ and $R_7$ in the general formula (III) are selected from the group consisting of the substituents of $R_1$ when $R_1$ is an aromatic group. When two or more substituents are present, they may be the same or different from one another.

$R_8$ in the general formula (III) is preferably a hydrogen atom, aliphatic acyl group or aliphatic sulfonyl group. Among them, hydrogen atom is particularly preferred. $Y_3$ is preferably a sulfur-, oxygen- or nitrogen-linked coupling-off type group. Among them, the sulfur-linked coupling-off type group is particularly preferred.

The compounds of the general formula (IV) are five-membered/five-membered condensed nitrogen-containing heterocyclic couplers (hereinafter referred to as 5,5 N-heterocyclic couplers). The color mother nucleus of this compound has an isoelectronic aromaticity with naphthalene and it has a chemical structure known generically as "azapentalene". Among the couplers of the general formula (IV), preferred are 1H-imidazo[1,2-b]pyrazoles, 1H-pyrazolo[5,1-c][1,2,4]triazoles, 1H-pyrazolo[1,5-b][1,2,4]triazoles and 1H-pyrazolo[1,5-d]tetrazoles.

The substituents of the phenyl group of the N-phenylcarbamoyl group Q in the general formula (V) are selected from the group consisting of the substituents of the aromatic groups $R_1$. When two or more substituents are present, they may be the same or different from one another.

Preferred group Q is that represented by the following general formula (VA):

(VA)

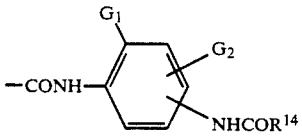

wherein $G_1$ represents a halogen atom or alkoxy group, $G_2$ represents a hydrogen atom, halogen atom or substituted or unsubstituted alkoxy group and $R^{14}$ represents a substituted or unsubstituted alkyl group.

Typical examples of the substituents of $G_2$ and $R^{14}$ in the general formula (VA) include alkyl, alkoxy, aryl and aryloxy groups.

Preferred coupling-off groups $Y_5$ include groups of the following general formulae (X) to (XVI):

(X)

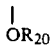

wherein $R_{20}$ represents a substituted or unsubstituted aryl group or a heterocyclic group, (XI)

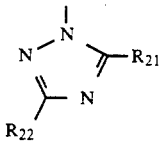

(XII)

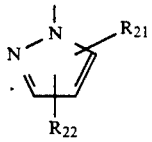

wherein $R_{21}$ and $R_{22}$ each represent a hydrogen atom, halogen atom, carboxylic ester group, amino group, alkyl group, alkylthio group, alkoxyl group, alkylsulfonyl group, alkylsulfinyl group, carboxylic acid group, sulfonic acid group, or substituted or unsubstituted phenyl or heterocyclic group, $R_{21}$ and $R_{22}$ being either the same or different from each other, (XIII)

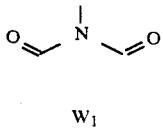

wherein $W_1$ represents a non-metallic atom necessitated for forming a four-, five- or six-membered ring together with

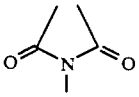

in the above formula, (XIV)

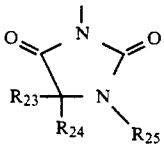

(XV)

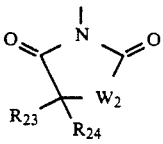

(XVI)

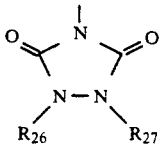

wherein $R_{23}$ and $R_{24}$ each represent a hydrogen atom, or an alkyl, aryl, alkoxy, aryloxy or hydroxyl group, $R_{25}$, $R_{26}$ and $R_{27}$ each represent a hydrogen atom, or an alkyl, aryl, aralkyl or acyl group and $W_2$ represents an oxygen or sulfur atom.

In this invention, when $Y_5$ is the coupling-off group represented by the general formulas (XI), (XII), (XIII), (XIV), (XV) or (XVI), the yellow stain causing after processing can be effectively inhibited.

Examples of preferred cyan couplers of the general formulae (I) and (II) including the following compounds:

(C-1)

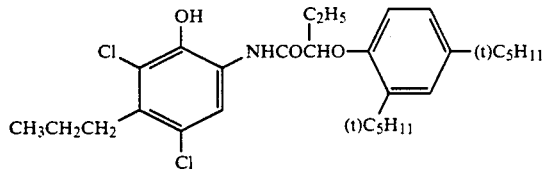

(C-2)

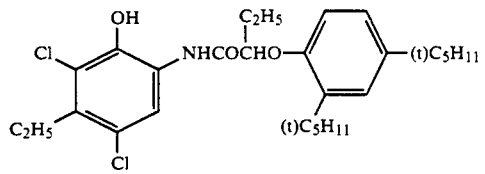

(C-3)

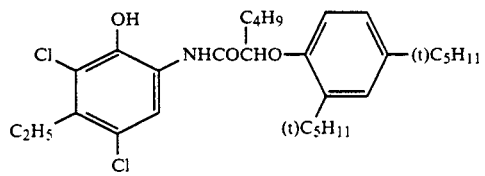

(C-4)

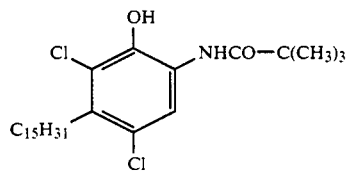

(C-5)

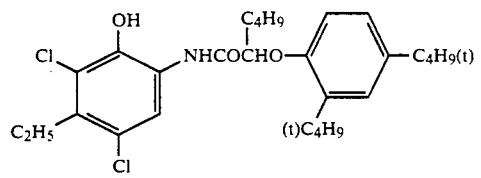

(C-6)

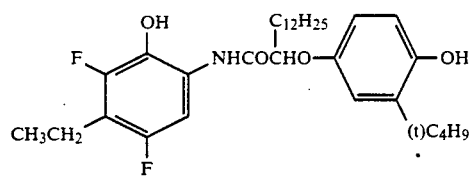

(C-7)

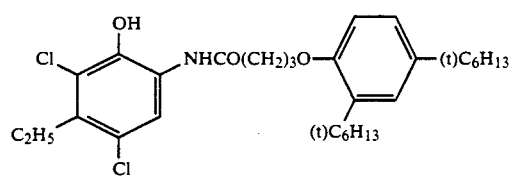

(C-8)

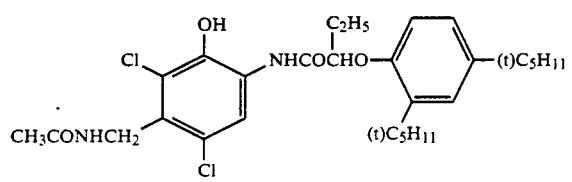

-continued
(C-9)
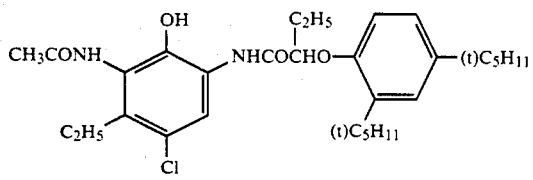
(C-10)
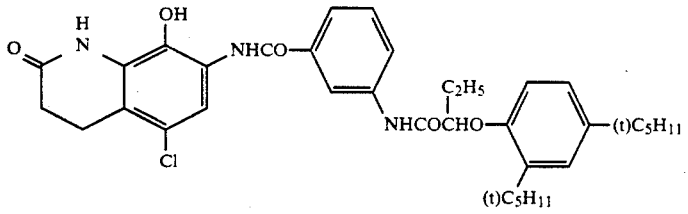
(C-11)
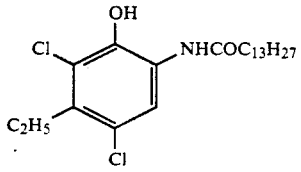
(C-12)
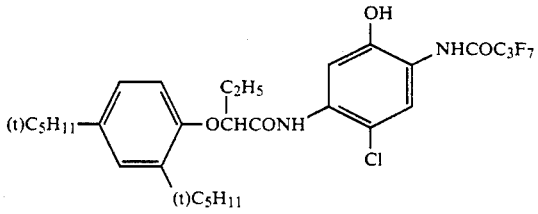
(C-13)
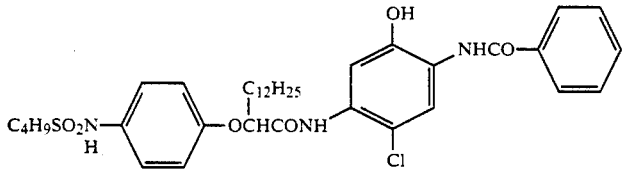
(C-14)
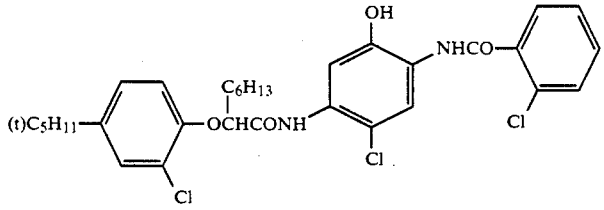
(C-15)
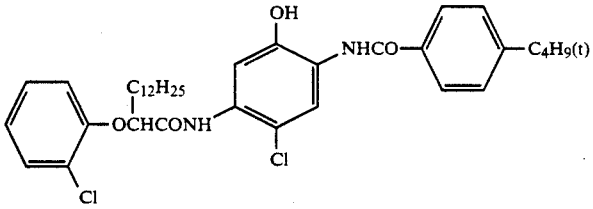
(C-16)
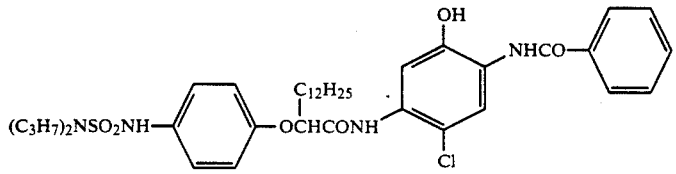

-continued
(C-17)
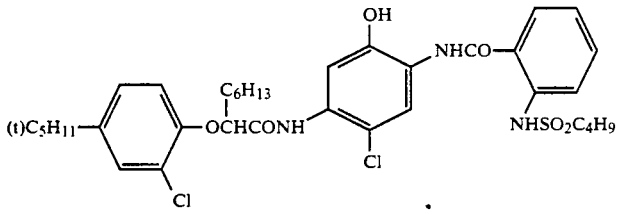
(C-18)
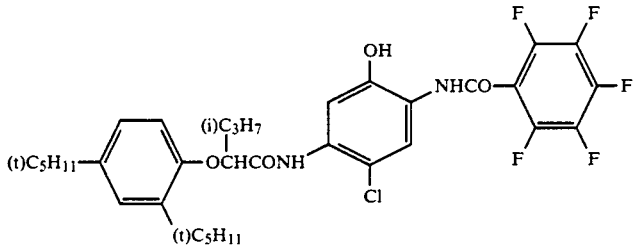
(C-19)
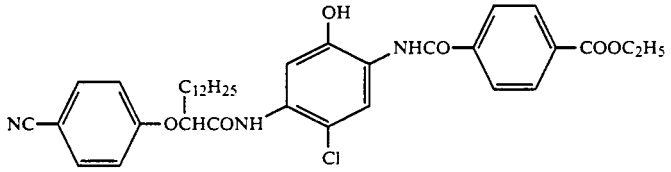
(C-20)
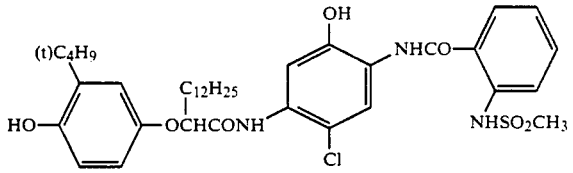
(C-21)
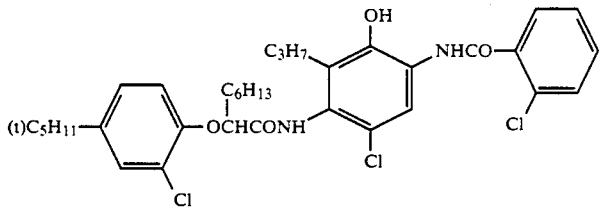
(C-22)
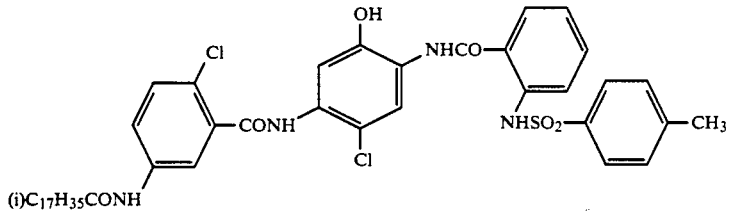
(C-23)
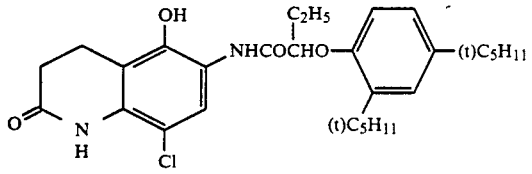

-continued
(C-24)
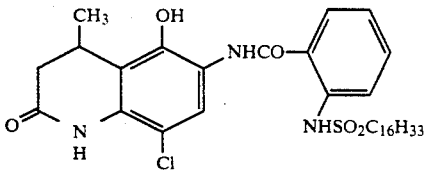
(C-25)
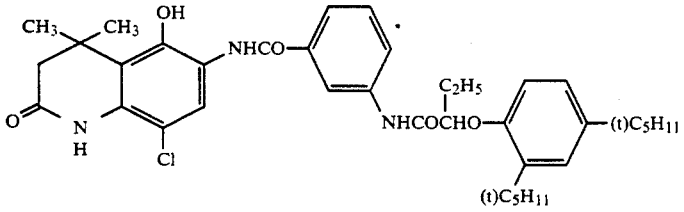
(C-26)
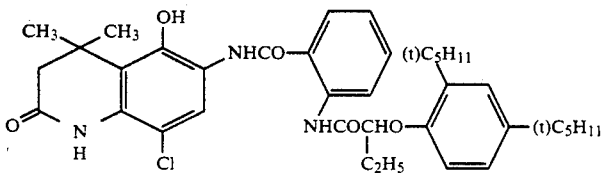
(C-27)
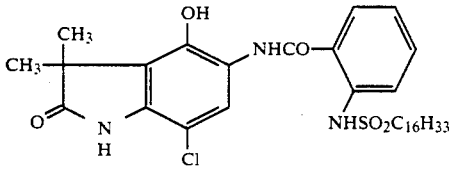
(C-28)
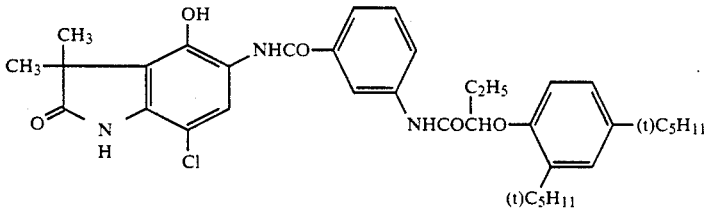
(C-29)
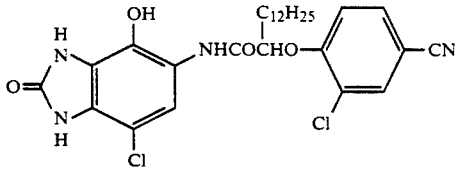
(C-30)
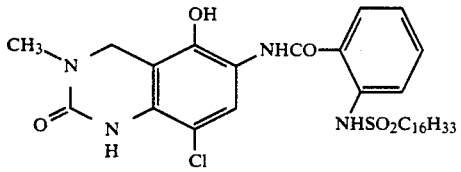
(C-31)
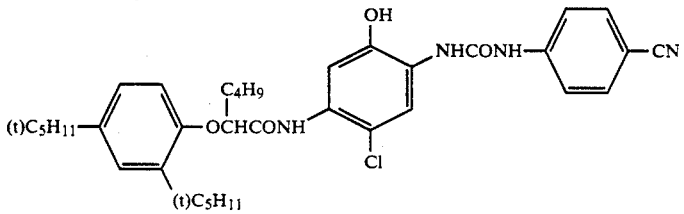

-continued
(C-32)
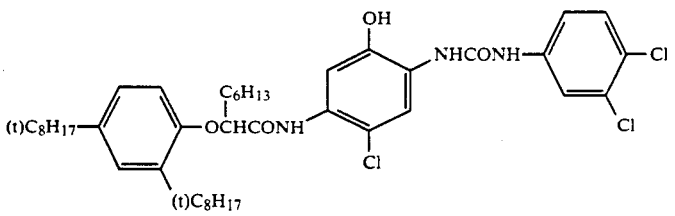
(C-33)
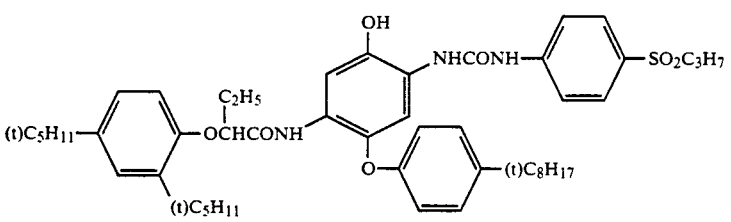
Examples of preferred couplers of the general formula (III) include the following compounds:
(M-1)
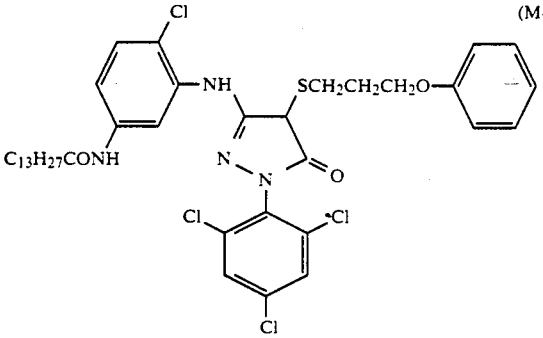
(M-2)
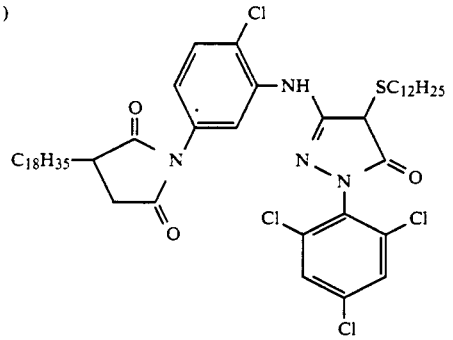
(M-3)
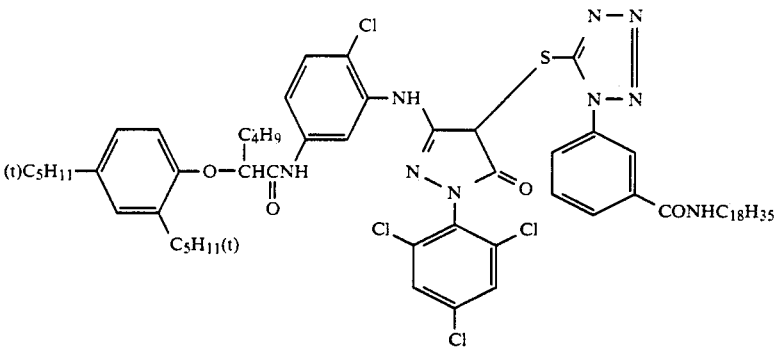
(M-4)
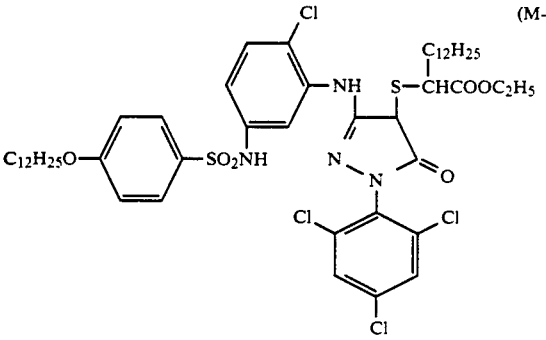
(M-5)
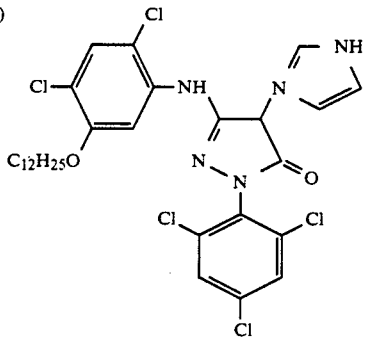

-continued
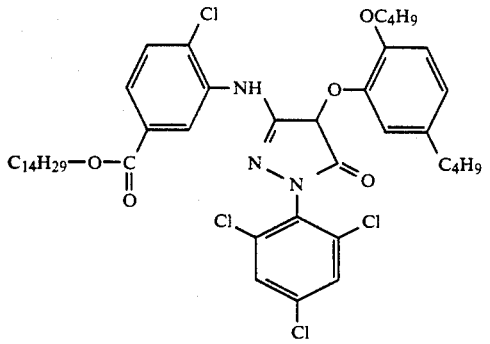
(M-6)
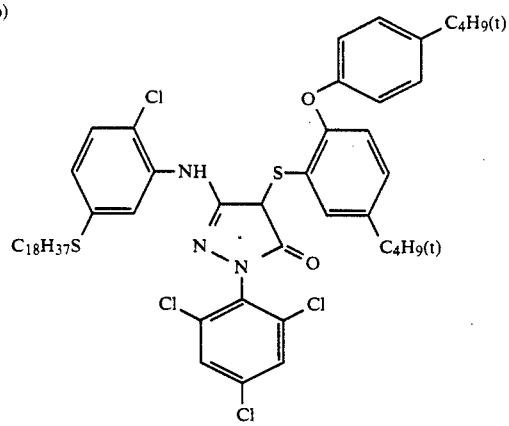
(M-7)
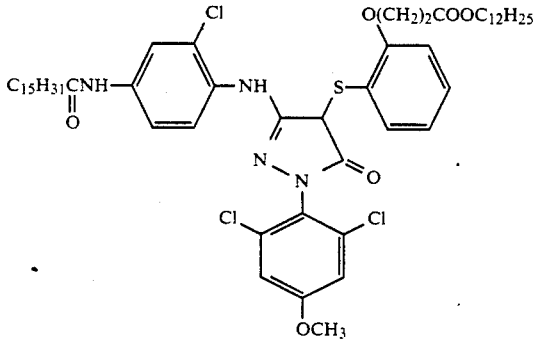
(M-8)
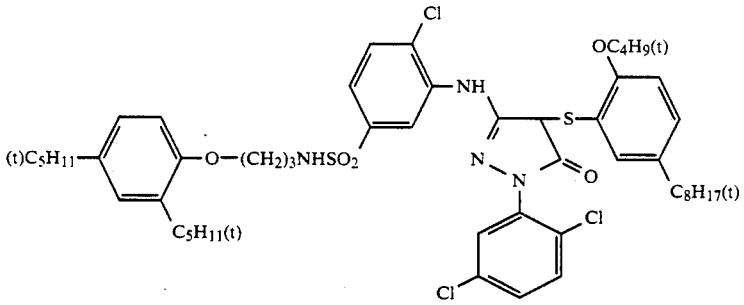
(M-9)
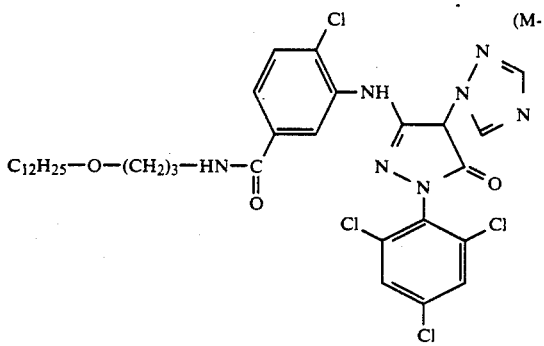
(M-10)
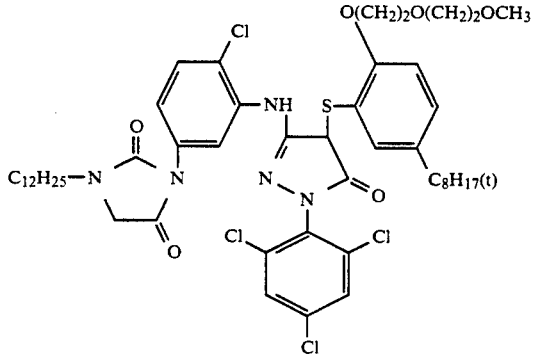
(M-11)

-continued
(M-12)
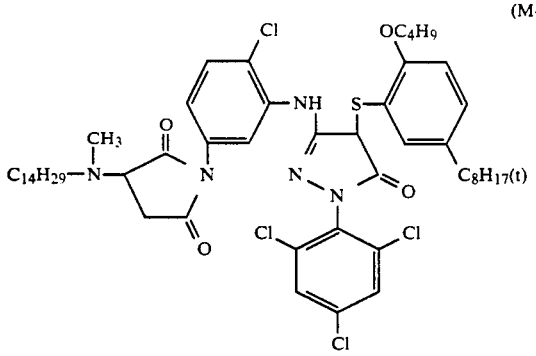
(M-13)
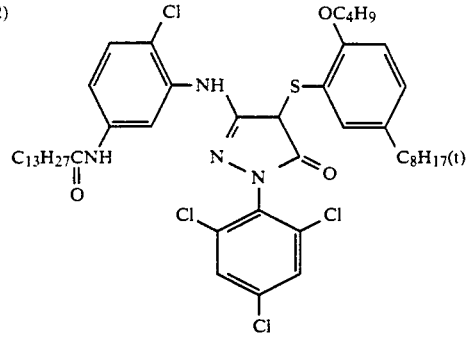
(M-14)
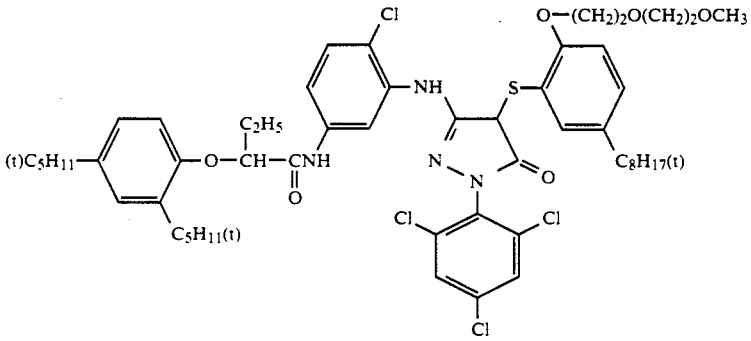
(M-15)
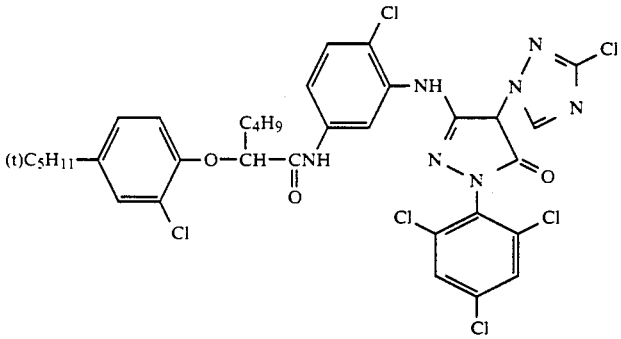
(M-16)
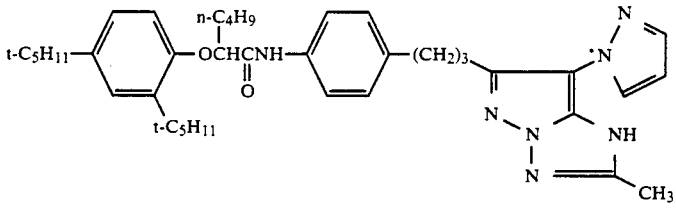
(M-17)
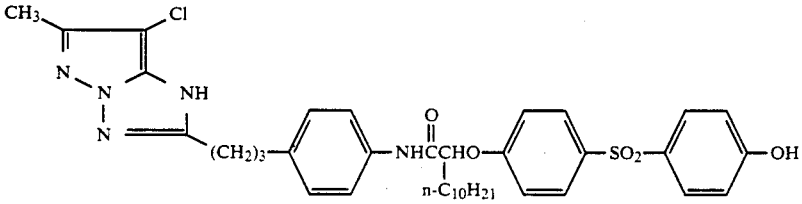

-continued
(M-18)
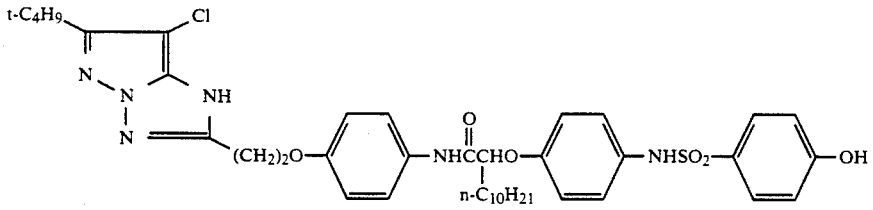
(M-19)
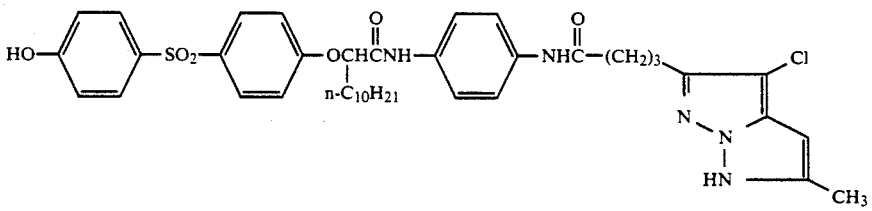
(M-20)
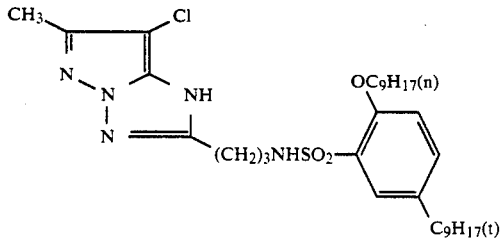
(M-21)
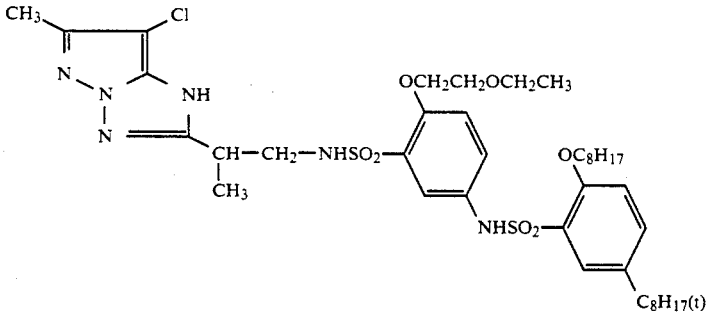
(M-22)
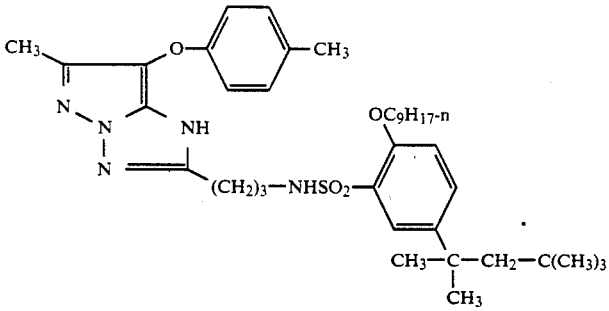
(M-23)
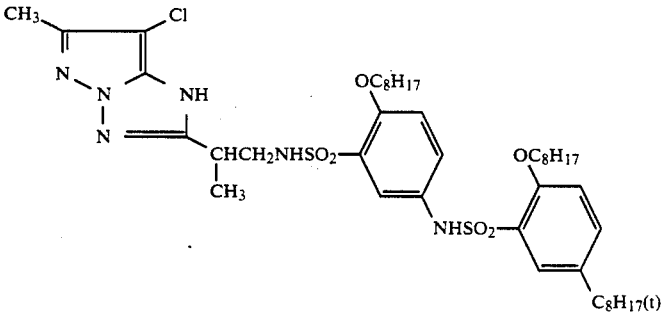

-continued
(M-24)
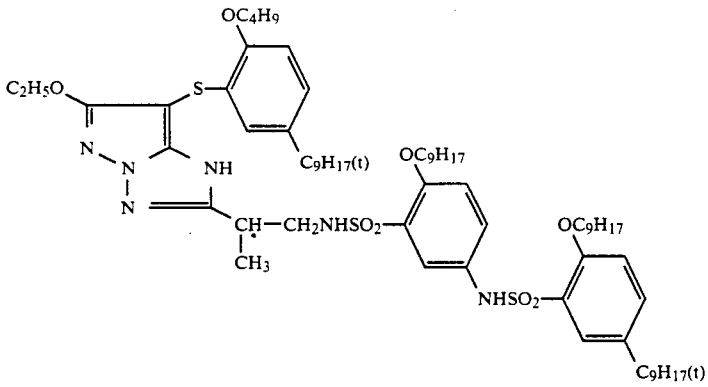
(M-25)
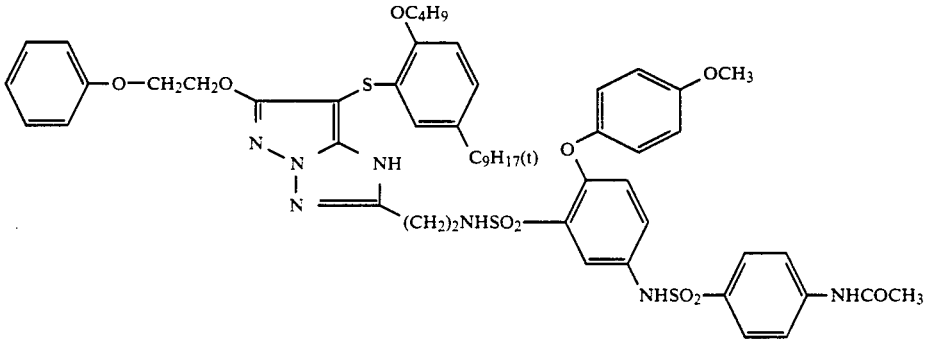
(M-26)
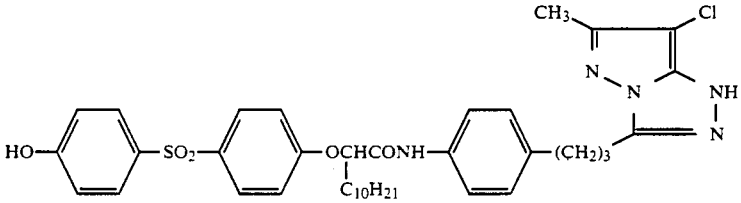
(M-27)
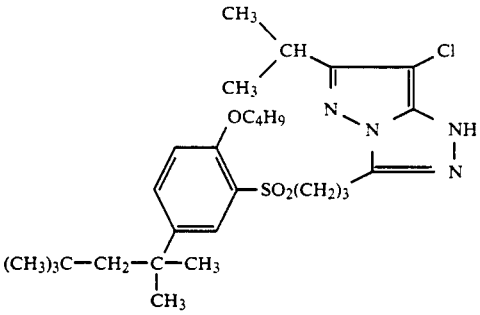
(M-28)
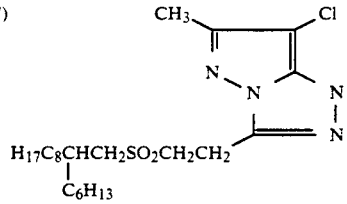
Examples of preferred couplers of the general formula (V) include the following compounds:
(Y-1)
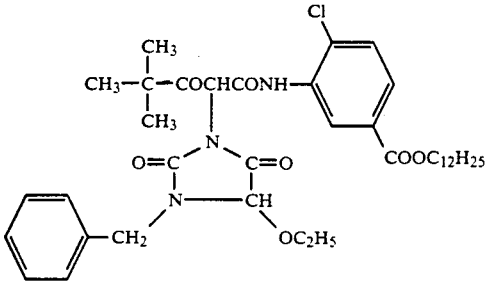

-continued
(Y-2)
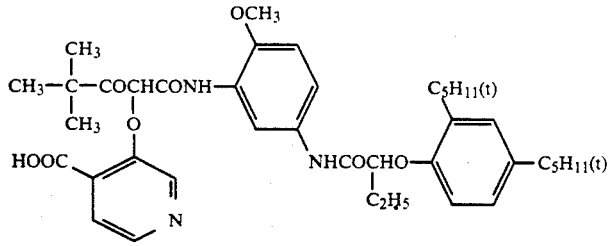
(Y-3)
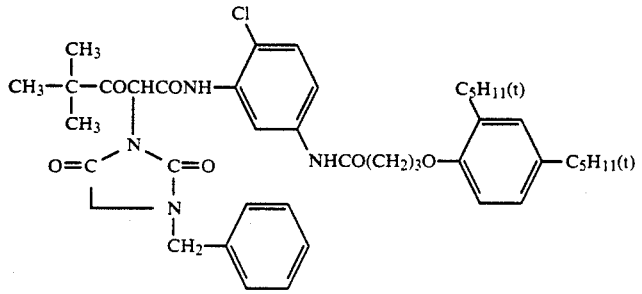
(Y-4)
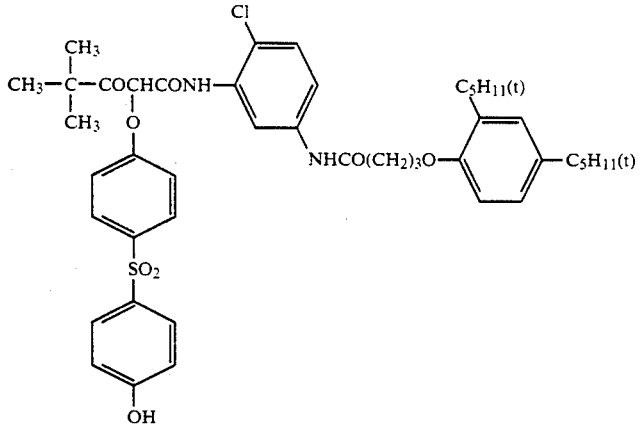
(Y-5)
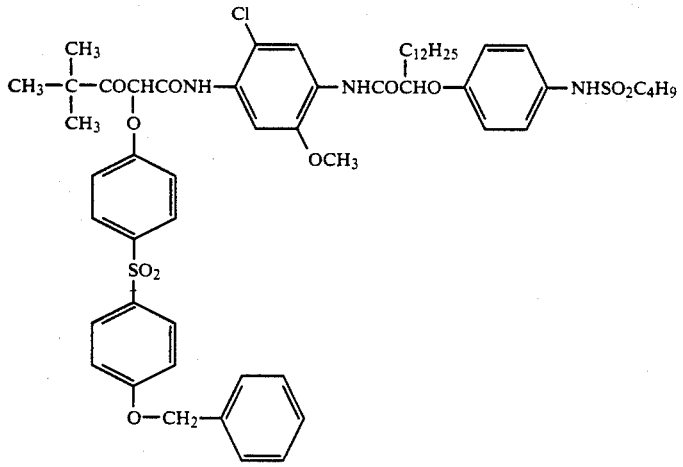

-continued
(Y-6)
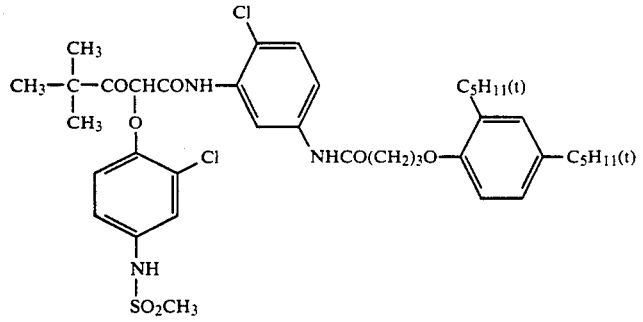
(Y-7)
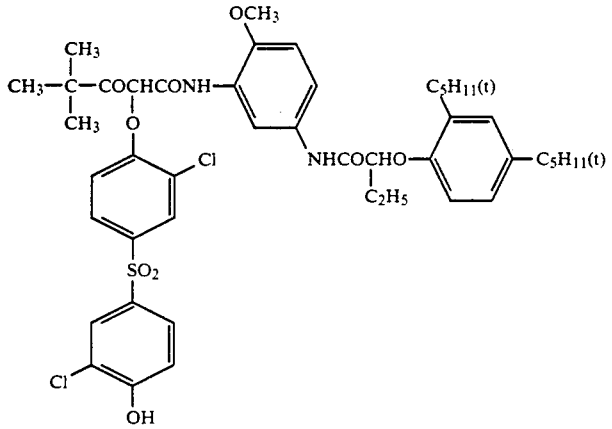
(Y-8)
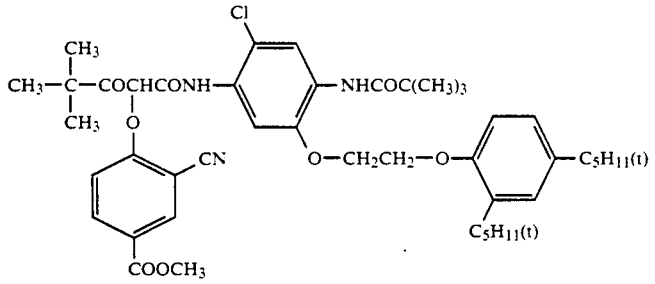
(Y-9)
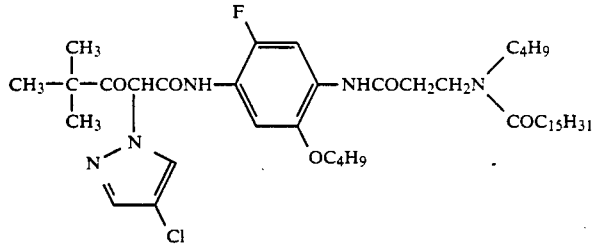
(Y-10)
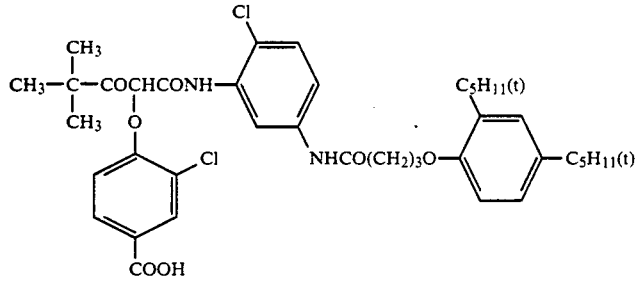

-continued
(Y-11)
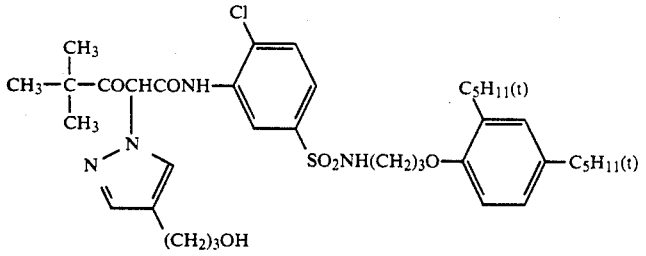
(Y-12)
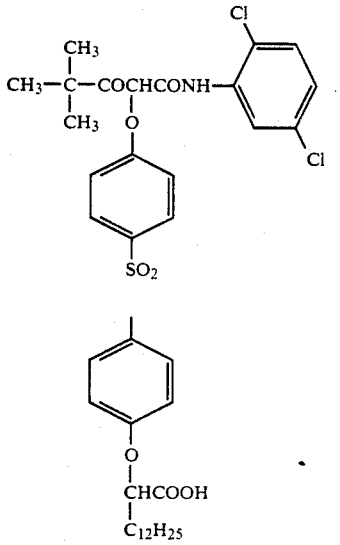
(Y-13)
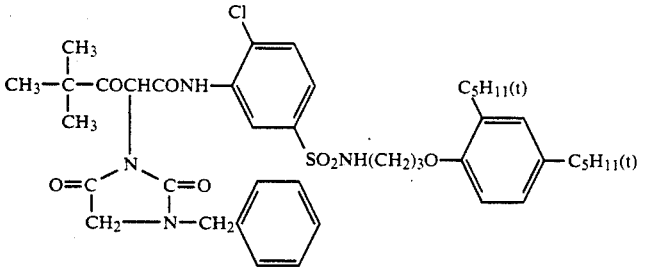
(Y-14)
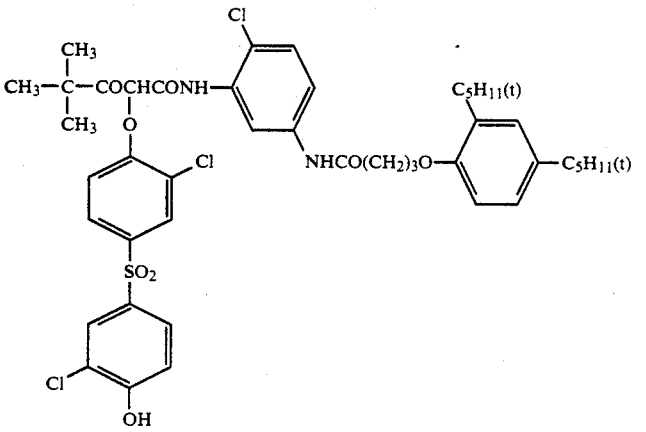

-continued
(Y-15)
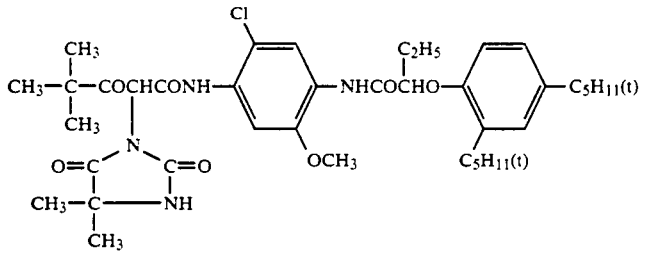
(Y-16)
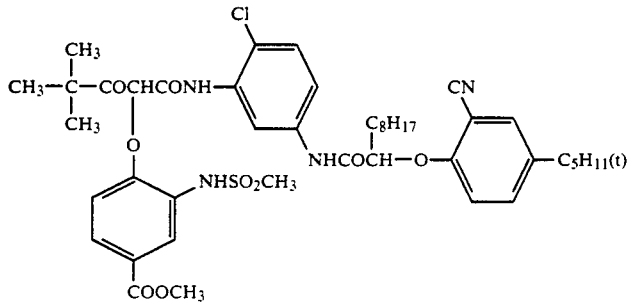
(Y-17)
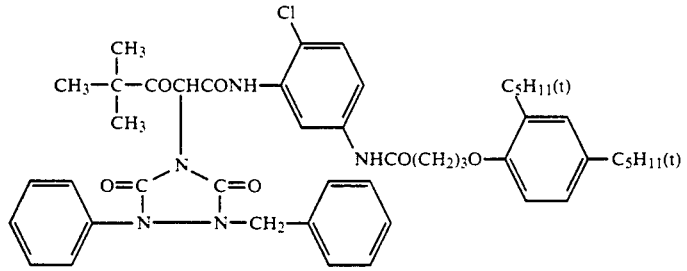
(Y-18)
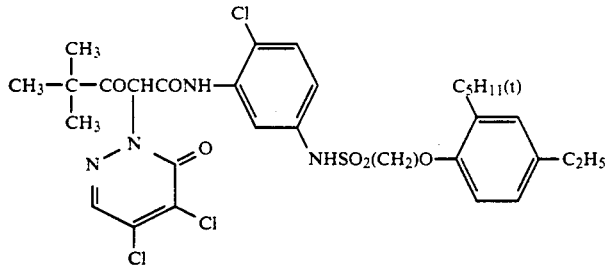
(Y-19)
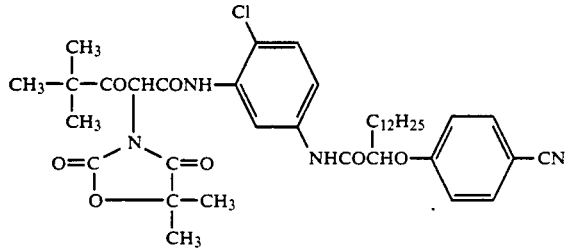

-continued
(Y-20)
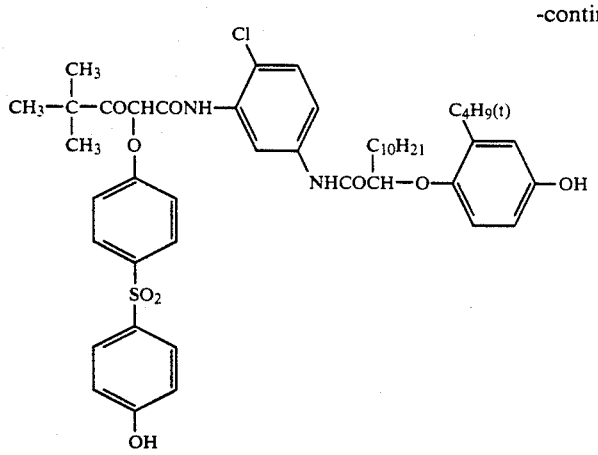
(Y-21)
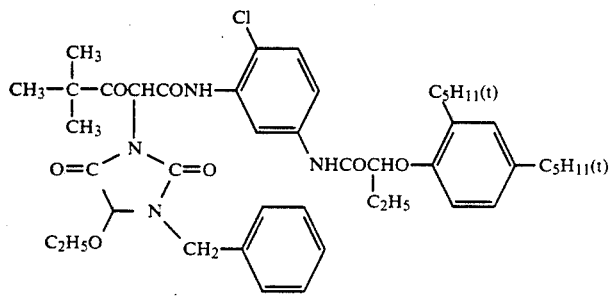
(Y-22)
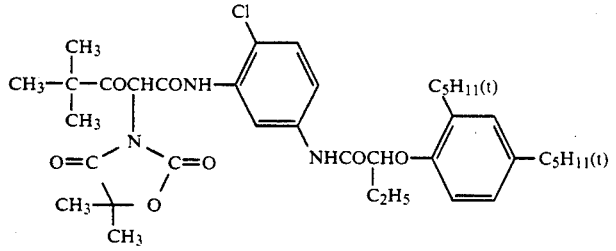
(Y-23)
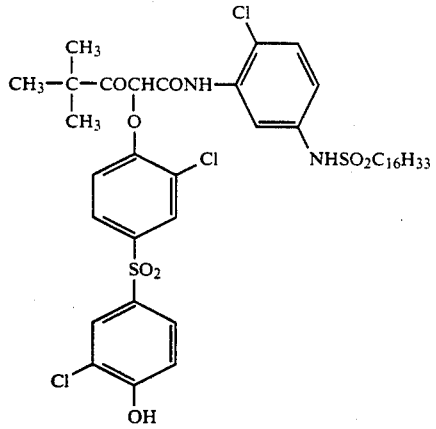
(Y-24)
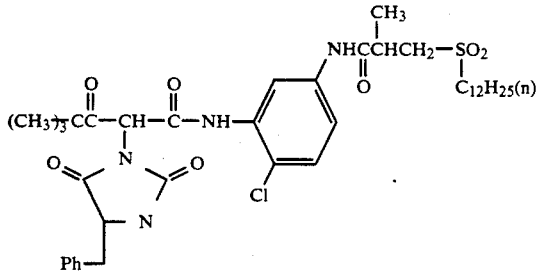

-continued (Y-25)

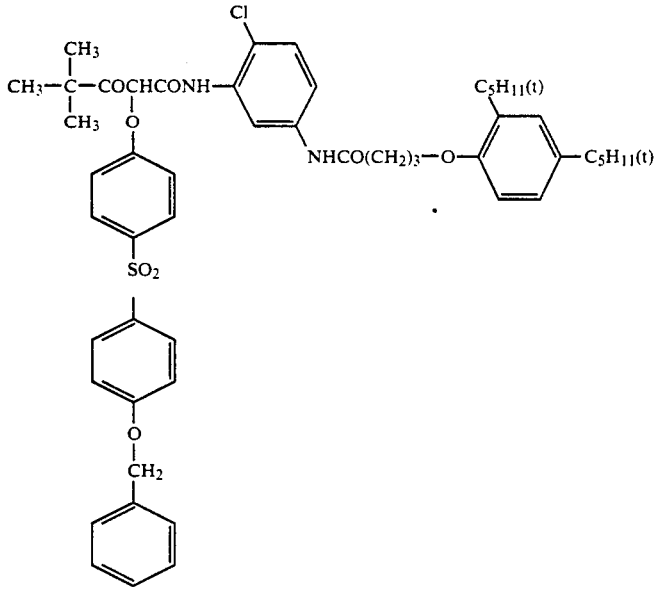

The couplers of the above general formulae (I) to (V) were disclosed in J.P.A. No. 61-13416 (J.P. KOKAI No. 63-11939, EP231832A). In particular, the general formulae of them and processes for preparing them are described on pages 17 to 34 and pages 34 to 35, respectively, of the above-mentioned J.P.A. No. 61-13416. Further, compounds (C-1) to (C-3), (M-1) to (M-12), (M-16) to (M-30) and (Y-1) to (Y-39) mentioned on pages 36 to 78 of the same Application are usable in the present invention.

When the magenta coupler represented by the general formula (IV) is used, the magenta stain causing after processing and with time can be effectively inhibited.

The graininess can be improved by using a coupler in which the color dye has a suitable diffusibility in combination with the coupler of the present invention. Such dye diffusion couplers include, for example, magenta couplers described in U.S. Pat. No. 4,366,237 and British Patent No. 2,125,570, and yellow, magenta and cyan couplers described in European Patent No. 96,570 and West German Patent Unexamined Published Application No. 3,234,533.

The dye-forming couplers and the above-mentioned special couplers may form dimers or higher polymers. Typical examples of the polymerized, dye-forming couplers are described in U.S. Pat. Nos. 3,451,820 and 4,080,211. Examples of the polymerized magenta couplers are described in British Patent No. 2,102,173 and U.S. Pat. No. 4,367,282.

Two or more kinds of the couplers used in the present invention can be contained in a photosensitive layer of a photosensitive material or, alternatively, one of the couplers can be contained in two or more layers thereof in order to satisfy necessary conditions of the photosensitive material.

The standard amount of the color coupler used is in the range of 0.001 to 1 mol per mol of the photosensitive silver halide. It is preferably 0.01 to 0.5 mol (yellow coupler), 0.003 to 0.3 mol (magenta coupler) or 0.002 to 0.3 mol (cyan coupler).

The coupler used in the present invention can be introduced in the photosensitive material by various known dispersion methods. Examples of high-boiling organic solvents used in O/W dispersion-forming method are described in U.S. Pat. No. 2,322,027. The steps, effect and examples of latexes for impregnation used in latex dispersion-forming method are described in U.S. Pat. No. 4,199,363, and West German Patent Application (OLS) Nos. 2,541,274 and 2,541,230.

The silver halide emulsion used for forming the photosensitive material of the present invention is not limited. It is an emulsion of, for example, silver bromoiodide, silver bromide, silver chlorobromide or silver chloride. For example, in the rapid processing of color papers, etc. or in the processing at a low replenishing rate, a silver chlorobromide emulsion containing at least 60 molar % of silver chloride or a silver chloride emulsion is preferred and particularly an emulsion having a silver chloride content of 80 to 100 molar % is particularly preferred. When a high sensitivity is required and fog must be particularly controlled during the preparation, storage and/or processing, a silver chlorobromide emulsion having a silver bromide content of at least 50 molar % or a silver bromide emulsion which may have a silver iodide content of not higher than 3 molar % is preferred. Particularly an emulsion having a silver bromide content of at least 70 molar % is preferred. For the photographic color photosensitive material, silver bromoiodide or silver chlorobromoiodide having a silver iodide content of 3 to 15 molar % is preferred.

The silver halide grain according to the present invention may comprise (i) a core and a surface layer, (ii) a multiple layer structure, (iii) a wholly homogeneous phase or (iv) a combination of them.

The average grain size distribution of the silver halide grains usable in the present invention may be either narrow or wide. It is preferred, however, that the degree of variability calculated according to the following formula:

$$\text{(degree of variability)} = \frac{\text{(standard deviation in grain size distribution of silver halide grains in emulsion)}}{\text{(average grain size)}}$$

is 20% or below, particularly 15% or below. Such an emulsion preferably used in the present invention is called "monodisperse silver halide emulsion". To satisfy an intended gradation, two or more monodisperse silver halide emulsions (having preferably the above-mentioned degree of variability) can be incorporated in one layer of the photosensitive material or in two or more layers having substantially the same color sensitivity. Further, a combination of two or more polydisperse silver halide emulsions or a combination of a monodisperse emulsion with a polydisperse emulsion can be used by mixing them or by forming a multi-layer structure.

The silver halide grains usable in the present invention may be in a regular crystal form such as cubic, octahedral, rhom dodecahedral or tetradecahedral form; an irregular crystal form such as spherical form; or a complex crystal form thereof. Further, the grains may be in platy form. Particularly an emulsion of the platy grains in which the platy grains having a length/thickness ratio in the range of 5 to 8 or higher occupy at least 50% of the total projection area can be used. In addition, an emulsion of a combination of the crystals of various forms can also be used.

These emulsions may be those of either a surface-latent image type wherein the latent image is formed on the grain surfaces or internal latent image type wherein the latent image is formed in the grains.

The photographic emulsion used in the present invention can be prepared by a method described in Research Disclosure, Vol. 170, Item No. 17643, Paragraphs I, II and III (December, 1978).

The emulsion is usually subjected to a physical digestion, chemical digestion and spectral sensitization. The additives used in these steps are described in Research Disclosure, Vol. 176, No. 17643 (December, 1978) and Vol. 187, No. 18716 (November, 1979). The corresponding portions therein are summarized in the following table.

Also known photographic additives usable in the present invention are described in the above-mentioned two books of Research Disclosure and the corresponding portions therein are also shown in the following table.

| Kind of Additive | RD17643 | RD18716 |
|---|---|---|
| 1. Chemical sensitizer | p 23 | p 648, right col. |
| 2. Sensitizer | " | " |
| 3. Spectral sensitizer | p 23–24 | p 648, right col. to p 649, right col. |
| 4. Supersensitizer | " | p 648, right col. to p 649, right col. |
| 5. Whitener | p 24 | |
| 6. Antifoggant, stabilizer | p 24–25 | p 649, right col. |
| 7. Coupler | p 25 | " |
| 8. Organic solvent | p 25 | " |
| 9. Light absorber, filter dye | p 25–26 | p 649, right col. to p 650, left col. |
| 10. Ultraviolet absorber | " | p 649, right col. to p 650, left col. |
| 11. Antistaining agent | p 25 | p 650, left to right col. |

-continued

| Kind of Additive | RD17643 | RD18716 |
|---|---|---|
| 12. Dye image stabilizer | p 25 | p 650, left to right col. |
| 13. Hardening agent | p 26 | p 651, left col. |
| 14. Binder | " | " |
| 15. Plasticizer, lubricant | p 27 | p 650, right col. |
| 16. Coating aid, surfactant | p 26–27 | " |
| 17. Antistatic agent | p 27 | " |

The photographic photosensitive material usable in the present invention is applied to an ordinary flexible support such as a plastic film (e.g. cellulose nitrate, cellulose acetate or polyethylene terephthalate film) or paper, or a rigid support such as a glass plate. The details of the supports and the application methods are described in Research Disclosure, Vol. 176, Item 17643 XV (p. 27) and XVII (p. 28) (December, 1978).

The following examples will further illustrate the present invention.

EXAMPLE 1

A multi-layer photographic printing paper having the following layer structure was prepared by using a paper support laminated with polyethylene on both surfaces thereof. The coating solutions were prepared as follows:

Preparation of coating solution for forming the first layer 27.2 ml of ethyl acetate and 7.7 ml (8.0 g) of a high-boiling solvent (Solv-1) were added to a mixture of 10.2 g of a yellow coupler (ExY-1), 9.1 g of yellow coupler (ExY-2) and 4.4 g of a color image stabilizer (Cpd-1) to prepare a solution. The solution was dispersed in 185 ml of 10% aqueous gelatin solution containing 8 ml of 10% sodium dodecylbenzenesulfonate to prepare an emulsified dispersion. The dispersion was mixed with emulsions EM 1 and EM 2 to prepare a solution. The gelatin concentration was adjusted to obtain a composition which will be shown below. This was the coating solution for forming the first layer. The coating solutions for forming the second to the seventh layers were prepared in the same manner as above. Sodium salt of 1-hydroxy-3,5-dichloro-s-triazine was used as the hardener for gelatin in each layer.

(Cpd-2) was used as the thickening agent.

Layer structure

The compositions of the respective layers are shown below. The numerals refer to the amount of the coating (g/m$^2$). The amount of the silver halide emulsion is given in terms of silver applied.

| | |
|---|---|
| Support | |
| paper laminated with polyethylene [the polyethylene layer adjacent to the first layer contained a white pigment ($TiO_2$) and bluing dye] | |
| The first layer (blue-sensitive layer) | |
| monodisperse silver chlorobromide emulsion spectrally sensitized with sensitizing dye (ExS-1) (EM 1) | 0.13 |
| monodisperse silver chlorobromide emulsion spectrally sensitized with sensitizing dye (ExS-1) (EM 2) | 0.13 |
| gelatin | 1.86 |
| yellow coupler (ExY-1) | 0.44 |
| yellow coupler (ExY-2) | 0.39 |
| color image stabilizer (Cpd-1) | 0.19 |

-continued

| | |
|---|---|
| solvent (Solv-1) | 0.35 |
| The second layer (color mixing-inhibiting layer) | |
| gelatin | 0.99 |
| color mixing-inhibitor (Cpd-3) | 0.08 |
| The third layer (green-sensitive layer) | |
| monodisperse silver chlorobromide emulsion spectrally sensitized with sensizing dyes (ExS-2, 3) (EM 3) | 0.05 |
| monodisperse silver chlorobromide emulsion spectrally sensitized with sensizing dyes (ExS-2, 3) (EM 4) | 0.11 |
| gelatin | 1.80 |
| magenta coupler (ExM-1) | 0.39 |
| color image stabilizer (Cpd-4) | 0.20 |
| color image stabilizer (Cpd-5) | 0.02 |
| color image stabilizer (Cpd-6) | 0.03 |
| solvent (Solv-2) | 0.12 |
| solvent (Solv-3) | 0.25 |
| The fourth layer (U.V. ray-absorbing layer) | |
| gelatin | 1.60 |
| U.V. absorber (Cpd-7/Cpd-8/Cpd-9 weight ratio = 3/2/6) | 0.70 |
| color mixing-inhibitor (Cpd-10) | 0.05 |
| solvent (Solv-4) | 0.27 |
| The fifth layer (red-sensitive layer) | |
| monodisperse silver chlorobromide emulsion spectrally sensitized with sensitizing dyes (ExS-4 and 5) (EM 5) | 0.07 |
| monodisperse silver chlorobromide emulsion spectrally sensitized with sensitizing dyes (ExS-4 and 5) (EM 6) | 0.16 |
| gelatin | 0.92 |
| cyan coupler (ExC-1) | 0.32 |
| color image stabilizer (Cpd-8/Cpd-9/Cpd-12 weight ratio = 3/4/2) | 0.17 |
| polymer for dispersion (Cpd-11) | 0.28 |
| solvent (Solv-2) | 0.20 |

-continued

| | |
|---|---|
| The sixth layer (U.V.-absorbing layer) | |
| gelatin | 0.54 |
| UV-absorber (Cpd-7/Cpd-9/Cpd-12 weight ratio = 1/5/3) | 0.21 |
| solvent (Solv-2) | 0.08 |
| The seventh layer (protective layer) | |
| gelatin | 1.33 |
| acryl-modified polyvinyl alcohol copolymer (degree of modification: 17%) | 0.17 |
| liquid paraffin | 0.03 |

As irradiation-inhibiting dyes, Cpd-13 and Cpd-14 were used.

In forming the layers, Alkanol XC (a product of Du Pont), sodium alkylbenzenesulfonates, succinic esters and Magefacx F-120 (a product of Dainippon Ink Co., Ltd.) were used as emulsifying/dispersing agents and coating aids. Cpd-15 and Cpd-16 were used as the stabilizers for the silver halides.

The details of the emulsions used were as follows:

| Emulsion | Grain diameter (μ) | Br content (mol %) | Coefficient of variation |
|---|---|---|---|
| EM 1 | 1.0 | 80 | 0.08 |
| EM 2 | 0.75 | 80 | 0.07 |
| EM 3 | 0.5 | 83 | 0.09 |
| EM 4 | 0.4 | 83 | 0.10 |
| EM 5 | 0.5 | 73 | 0.09 |
| EM 6 | 0.4 | 73 | 0.10 |

The structural formulae of the compounds used are as follows:

ExY-1

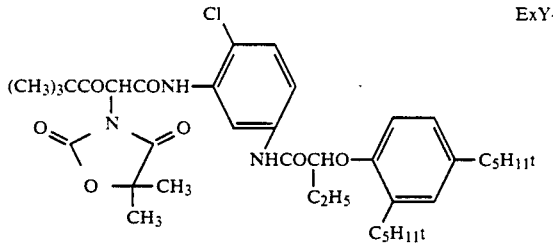

(the same as Y-21) ExY-2

(the same as M-21) ExM-1

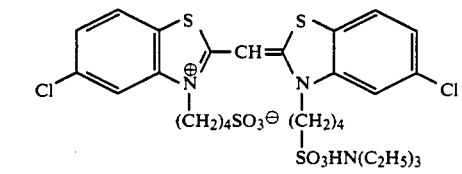

(the same as C-11) ExC-1

ExS-1

ExS-2

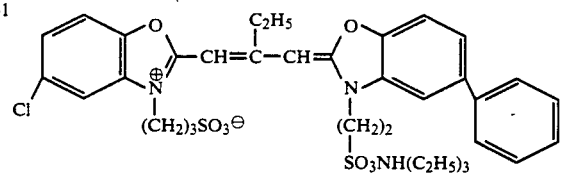

ExS-3

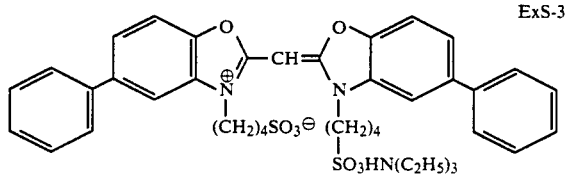

ExS-4

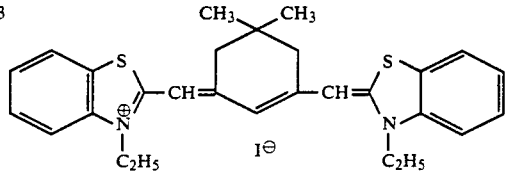

-continued
ExS-5
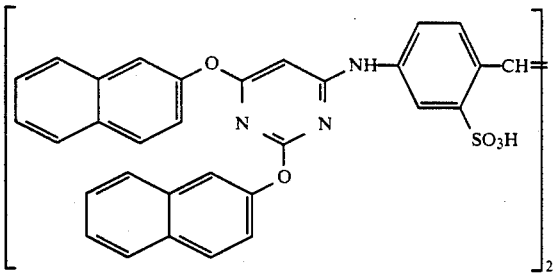
Cpd-1
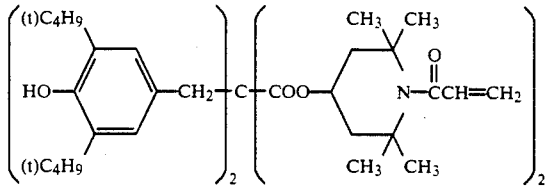
Cpd-2
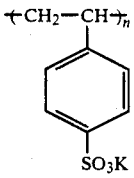
Cpd-3
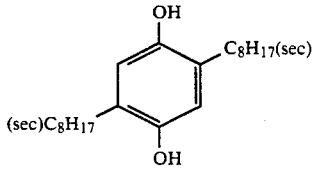
Cpd-4
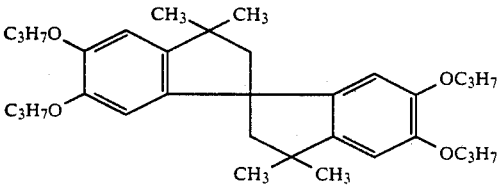
Cpd-5
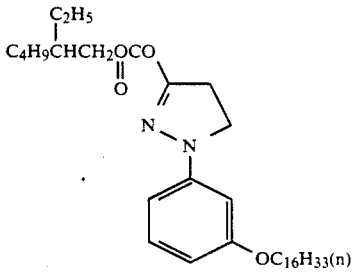
Cpd-6
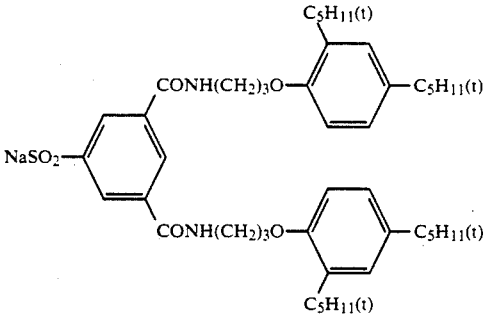
Cpd-7
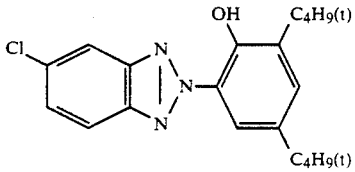
Cpd-8
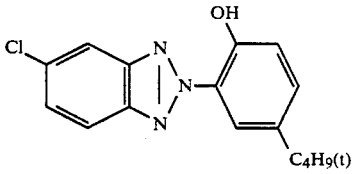
Cpd-9
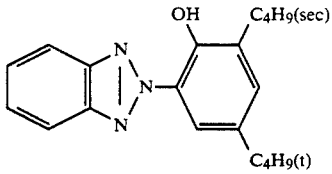
Cpd-10
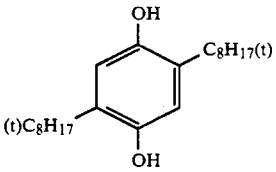
Cpd-11
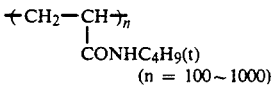
Cpd-12
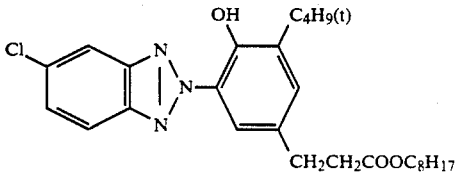
Dibutyl phthalate Solv-1
Tricresyl phosphate Solv-2
Trioctyl phosphate Solv-3

-continued

Trinonyl phosphate Solv-4

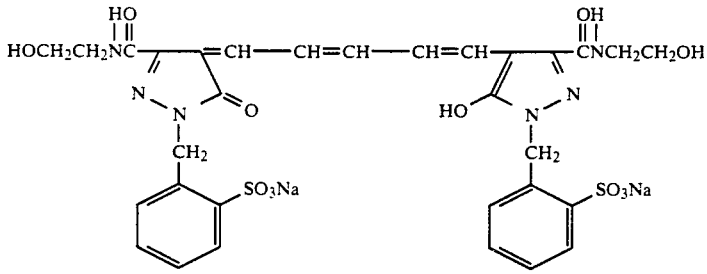

Cpd-13

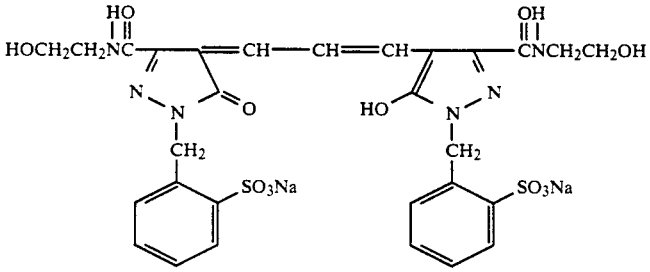

Cpd-14

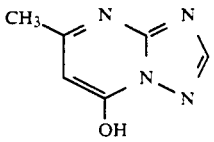

Cpd-15

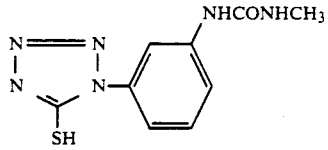

Cpd-16

An alkali-treated gelatin having an isoelectric point of 5 was used in all cases. The sample will be referred to as Sample 1-A.

The Sample 1-A was subjected to an imagewise exposure and then continuously processed in the steps described below with bleach-fixing solutions having various compositions while the quantity of replenished water for washing was varied under various conditions until the quantity of the replenisher became twice as much as the volume of the color developer tank.

| Processing step | Temperature | Time | Amount of replenisher* | Tank volume |
|---|---|---|---|---|
| Color development | 38° C. | 1 min 40 sec | 290 ml | 17 l |
| Bleach-fixing | 33° C. | 40 sec | 100 ml | 9 l |
| Water washing (1) | 30 to 34° C. | 15 sec | — | 4 l |
| Water washing (2) | 30 to 34° C. | 15 sec | — | 4 l |
| Water washing (3) | 30 to 34° C. | 15 sec | see Table 1 | 4 l |
| Drying | 70 to 80° C. | 50 sec | | |

*per $m^2$ of the photosensitive material [counter current system in three washing tanks; (3) → (1)]

**The quantity brought therein from the pre-processing bath was 30 ml/$m^2$.

The processing solutions had the following compositions:

| | Tank solution | Replenisher |
|---|---|---|
| Color developer | | |
| water | 800 ml | 800 ml |

-continued

| | Tank solution | Replenisher |
|---|---|---|
| biethylenetriaminepentaacetic acid | 1.0 g | 1.0 g |
| nitrilotriacetic acid | 2.0 g | 2.0 g |
| 1-hydroxyethylidene-1,1-di-phosphonic acid | 2.0 g | 2.0 g |
| potassium bromide | 0.5 g | — |
| potassium carbonate | 30 g | 30 g |
| N-ethyl-N-(β-methanesulfonamido-ethyl)-3-methyl-4-aminoaniline sulfate | 5.5 g | 7.5 g |
| N,N-diethylhydroxylamine | 3.6 g | 5.5 g |
| fluorescent brightening agent (WHITEX 4; a product of Sumitoto Chemical Co., Ltd.) | 1.5 g | 2.0 g |
| triethylenediamine(1,4-diazabicyclo [2,2,2]octane | 5.0 g | 5.0 g |
| water | ad 1000 ml | ad 1000 ml |
| pH (25° C.) | 10.20 | 10.060 |
| Bleach-fixing solution* | | |
| water | 400 ml | 400 ml |
| ammonium thiosulfate (70%) | 200 ml | 300 ml |
| sodium sulfite | 20 g | 40 g |
| iron (III) ammonium ethylenediamine-tetraacetate | 60 g | 120 g |
| disodium ethylenediaminetetraacetate | 5 g | 10 g |
| water | ad 1000 ml | ad 1000 ml |
| pH (25° C.) | | |

pH was adjusted with aqueous ammonia and hydrochloric acid as shown in Table 1.

Water Washing

Ion-exchanged water (having calcium content of not higher than 3 ppm and magnesium content of not higher than 3 ppm) was used.

TABLE 1

| Process No. | Running conditions: Bleach-fixing solution (pH): Solution in tank (start) | Replenisher | Solution in tank after completion of running | Washing water: Amount of replenisher (ml) | Amount of replenisher/amount of water brought therein | Remarks |
|---|---|---|---|---|---|---|
| 1 | 3.0 | 2.5 | 3.3 | 240 | 8 | Comparative Example |
| 2 | 4.0 | 3.5 | 3.9 | " | " | Present Invention |
| 3 | 5.0 | 4.5 | 5.0 | " | " | Present Invention |
| 4 | 6.0 | 5.5 | 5.9 | " | " | Comparative Example |
| 5 | 7.0 | 6.5 | 7.0 | " | " | Comparative Example |
| 6 | 4.5 | 3.0 | 4.4 | 60 | 2 | Comparative Example |
| 7 | " | 4.0 | " | 240 | 8 | Present Invention |
| 8 | " | 4.2 | " | 600 | 20 | Present Invention |
| 9 | " | 4.2 | " | 1200 | 40 | Present Invention |
| 10 | " | 4.3 | " | 1800 | 60 | Comparative Example |

The bleach-fixing solution and the running solution in the tank for water washing (1) were placed in a 300 ml open beaker and left to stand at room temperature. Number of days required until the solution was deteriorated (converted into sulfide) was determined.

After completion of the running, the amount of silver remaining in $D_{max}$ area of the photographic paper was determined by fluorescent X-ray method. Simultaneously, the reflection density of cyan in $D_{max}$ area was determined with a Macbeth densitometer. Then the paper was immersed in CN-16 $N_2$ (a preocessing agent of Fuji Photo Film Co., Ltd.) at 30° C. for 4 min to convert the cyan leuco product into the dye again. Thereafter the reflection density was again determined. The coloring rate of the cyan dye was determined according to the following formula:

$$\text{Coloring rate (\%)} = \frac{\text{(Reflection density of cyan before processing)}}{\text{(Reflection density of cyan after processing)}} \times 100$$

The reflection density in a white area ($D_{min}$) of the processed printing paper was determined with the Macbeth densitometer. After leaving it to stand under conditions comprising a temperature of 60° C. and relative humidity of 70% for one month, the reflection density was again determined. An increase in the stain is shown in Table 2.

TABLE 2

| Process No. | Remarks | Stability (days): Bleach-fixing solution | Washing water 1 | Amount of remaining silver ($\mu g/cm^2$) | Coloring rate (%) | $\Delta D_{min}$ (stain increase): B | G | R |
|---|---|---|---|---|---|---|---|---|
| 1 | Comparative Example | 4 | 3 | 1.3 | 75 | +0.19 | +0.06 | +0.06 |
| 2 | Present Invention | 45 | 35 | 1.3 | 95 | +0.11 | +0.04 | +0.04 |
| 3 | Present Invention | 43 | 33 | 1.4 | 98 | +0.12 | +0.05 | +0.05 |
| 4 | Comparative Example | 18 | 12 | 4.0 | 97 | +0.20 | +0.10 | +0.10 |
| 5 | Comparative Example | 25 | 20 | 7.0 | 98 | +0.22 | +0.12 | +0.11 |
| 6 | Comparative Example | 33 | 25 | 1.3 | 90 | +0.20 | +0.10 | +0.09 |
| 7 | Present Invention | 43 | 35 | 1.3 | 99 | +0.12 | +0.05 | +0.05 |
| 8 | Present Invention | 44 | 35 | 1.2 | 99 | +0.11 | +0.04 | +0.04 |
| 9 | Present Invention | 44 | 30 | 1.2 | 98 | +0.11 | +0.04 | +0.04 |
| 10 | Comparative Example | 44 | 15 | 1.2 | 79 | +0.11 | +0.04 | +0.04 |

It is apparent from Table 2 that when an ordinary bleach-fixing solution (No. 4 or 5) was used, the desilverizability and image-maintenance are impaired and that when pH of the bleach-fixing solution is too low, problems such as reduction of stability of the solution (No.1), conversion of the cyan dye into leuco product and formation of yellow stains are posed. When the amount of replenished washing water is larger than that of the present invention, the cyan dye is converted into leuco product and the water becomes unstable. These problems can be solved by the present invention (Nos. 2, 3, 7, 8 and 9).

EXAMPLE 2

The same procedure as that of Example 1 was repeated except that iron (III) ammonium ethylenediaminetetraacetate used as the bleaching agent was replaced with iron (III) ammonium diethylenetriaminepentaacetate. The product had excellent properties.

EXAMPLE 3

The same procedure as that of Example 1 was repeated except that iron (III) ammonium ethylenediaminetetraacetate used as the bleaching agent was replaced with iron (III) ammonium cyclohexanediaminetetraacetate. The product had excellent properties.

EXAMPLE 4

A sample of a multi-layer color photographic material comprising layers having compositions (which will be described below) formed on a primed cellulose triacetate film as the support was prepared.

Compositions of photosensitive layers

In the following formulations, the amounts of silver halides and colloidal silver are given in terms of silver ($g/m^2$), the amounts of the coupler, additives and gelatin are given in terms of $g/m^2$ and those of sensitizing dyes are given in terms of molar number per mol of a silver halide contained in the same layer.

| | |
|---|---|
| The first layer (antihalation layer) | |
| black colloidal silver | 0.2 |
| gelatin | 1.3 |
| coupler C-1 | 0.06 |
| ultraviolet absorber (UV-1) | 0.1 |
| ultraviolet absorber (UV-2) | 0.2 |
| disperse oil (Oil-1) | 0.01 |
| disperse oil (Oil-2) | 0.01 |
| The second layer (intermediate layer) | |
| fine silver bromide grains (average grain diameter: 0.07μ) | 0.15 |
| gelatin | 1.0 |
| coupler (C-2) | 0.02 |
| disperse oil (Oil-1) | 0.1 |
| The third layer (the first red-sensitive emulsion layer) | |
| silver bromoiodide emulsion (silver iodide content: 2 molar %, diameter/thickness ratio: 2.5, average grain diameter: 0.3μ, internal, high AgI type) | 0.4 (silver) |
| gelatin | 0.6 |
| sensitizing dye (I) | $1.0 \times 10^{-4}$ |
| sensitizing dye (II) | $3.0 \times 10^{-4}$ |
| sensitizing dye (III) | $1 \times 10^{-5}$ |
| coupler (C-3) | 0.06 |
| coupler (C-4) | 0.06 |
| coupler (C-8) | 0.04 |
| coupler (C-2) | 0.03 |
| disperse oil (Oil-1) | 0.03 |
| disperse oil (Oil-3) | 0.012 |
| The fourth layer (the second red-sensitive emulsion layer) | |
| silver bromoiodide emulsion (silver iodide content: 5 molar %, diameter/thickness ratio: 4.0, average grain diameter: 0.7μ, internal, high AgI type) | 0.7 (silver) |
| sensitizing dye (I) | $1 \times 10^{-4}$ |

-continued

| | |
|---|---|
| sensitizing dye (II) | $3 \times 10^{-4}$ |
| sensitizing dye (III) | $1 \times 10^{-5}$ |
| coupler (C-3) | 0.24 |
| coupler (C-4) | 0.24 |
| coupler (C-8) | 0.04 |
| coupler (C-2) | 0.04 |
| disperse oil (Oil-1) | 0.15 |
| disperse oil (Oil-3) | 0.02 |
| The fifth layer (the third red-sensitive emulsion layer) | |
| silver bromoiodide emulsion (silver iodide content: 10 molar %, diameter/thickness ratio: 1.3, average grain diameter: 0.8μ, internal, high AgI type) | 1.0 (silver) |
| gelatin | 1.0 |
| sensitizing dye (I) | $1 \times 10^{-4}$ |
| sensitizing dye (II) | $3 \times 10^{-4}$ |
| sensitizing dy (III) | $1 \times 10^{-5}$ |
| coupler (C-6) | 0.05 |
| coupler (C-7) | 0.1 |
| disperse oil (Oil-1) | 0.01 |
| disperse oil (Oil-2) | 0.05 |
| The sixth layer (intermediate layer) | |
| gelatin | 1.0 |
| compound (Cpd-A) | 0.03 |
| disperse oil (Oil-1) | 0.05 |
| The seventh layer (the first green-sensitive emulsion layer) | |
| silver bromoiodide emulsion (silver iodide content: 2 molar %, diameter/thickness ratio: 2.5, average grain diameter: 0.3μ, internal, high AgI type) | 0.3 (silver) |
| sensitizing dye (IV) | $5 \times 10^{-4}$ |
| sensitizing dye (VI) | $0.3 \times 10^{-4}$ |
| sensitizing dye (V) | $2 \times 10^{-4}$ |
| gelatin | 1.0 |
| coupler (C-9) | 0.2 |
| coupler (C-5) | 0.03 |
| coupler (C-1) | 0.03 |
| compound (CPd-C) | 0.012 |
| disperse oil (Oil-1) | 0.5 |
| The eighth layer (the second green-sensitive layer) | |
| silver bromoiodide emulsion (silver iodide content: 4 molar %, diameter/thickness ratio: 4.0, average grain diameter: 0.6μ, internal, high AgI type) | 0.4 (silver) |
| sensitizing dye (IV) | $5 \times 10^{-4}$ |
| sensntizing dye (V) | $2 \times 10^{-4}$ |
| sensitizing dye (VI) | $0.3 \times 10^{-4}$ |
| coupler (C-9) | 0.25 |
| coupler (C-1) | 0.03 |
| coupler (C-10) | 0.015 |
| coupler (C-5) | 0.01 |
| compound (Cpd-C) | 0.012 |
| disperse oil (Oil-1) | 0.2 |
| The ninth layer (the third green-sensitive emulsion layer) | |
| silver bromoiodide emulsion (silver iodide content: 6 molar %, diameter/thickness ratio: 1.2, average grain diameter: 1.0μ, internal, high AgI type) | 0.85 (silver) |
| gelatin | 1.0 |
| sensitizing dye (VII) | $3.5 \times 10^{-4}$ |
| sensitizing dye (VIII) | $1.4 \times 10^{-4}$ |
| coupler (C-13) | 0.01 |
| coupler (C-12) | 0.03 |
| coupler (C-9) | 0.20 |
| coupler (C-1) | 0.02 |
| coupler (C-15) | 0.02 |
| disperse oil (Oil-1) | 0.20 |
| disperse oil (Oil-2) | 0.05 |
| The tenth layer (yellow filter layer) | |
| gelatin | 1.2 |
| yellow colloidal silver | 0.08 |
| compound (Cpd-B) | 0.1 |
| disperse oil (oil-1) | 0.3 |
| The eleventh layer (the first blue-sensitive emulsion layer) | |
| monodisperse silver bromoiodide emulsion (silver iodide content: 4 molar %, | 0.4 (silver) |

-continued

| | |
|---|---|
| diameter/thickess ratio: 1.5, average grain diameter: 0.5μ, internal, high AgI type) | |
| gelatin | 1.0 |
| sensitizing dye (IX) | $2 \times 10^{-4}$ |
| coupler (C-14) | 0.9 |
| coupler (C-5) | 0.07 |
| disperse oil (Oil-1) | 0.2 |
| The twelfth layer (the second blue-sensitive emulsion layer) | |
| silver bromoiodide emulsion (silver iodide content: 10 molar %, diameter/thickness ratio: 4.5, average grain diameter: 1.3μ, internal, high AgI type) | 0.4 (silver) |
| gelatin | 0.6 |
| sensitizing dye (IX) | $1 \times 10^{-4}$ |
| coupler (C-14) | 0.25 |
| disperse oil (Oil-1) | 0.07 |
| The thirteenth layer (the first protective layer) | |
| gelatin | 0.8 |

-continued

| | |
|---|---|
| UV absorber (UV-1) | 0.1 |
| UV absorber (UV-2) | 0.2 |
| disperse oil (Oil-1) | 0.01 |
| disperse oil (Oil-2) | 0.01 |
| The fourteenth layer (the second protective layer) | |
| fine silver bromide grains (average grain diameter: 0.07μ) | 0.5 |
| gelatin | 0.45 |
| polymethyl methacrylate grains (diameter: 1.5μ) | 0.2 |
| hardener (H-1) | 0.4 |
| n-butyl p-hydroxybenzoate | 0.012 |
| formaldehyde scavenger (S-1) | 0.5 |
| formaldehyde scavenger (S-2) | 0.5 |

A surfactant was incorporated as the coating aid, in addition to the above-mentioned components, in each layer.

The chemical structures or chemical names of the compounds used in this example are as follows:

UV-1

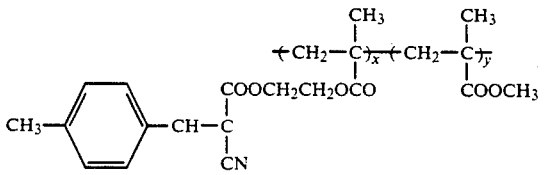

x/y - 7/3 (weight ratio)

UV-2

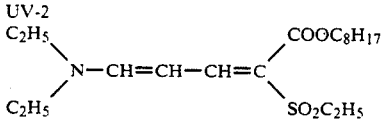

Oil-1 tricresyl phosphate
Oil-2 dibutyl phthalate
Oil-3 bis (2-ethylhexyl) phthalate

C-1

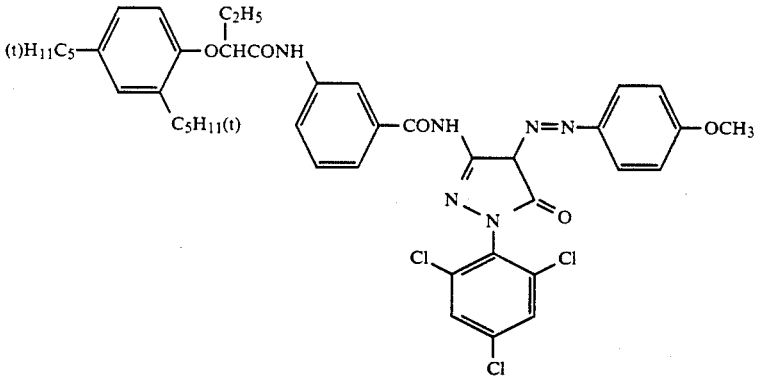

C-2

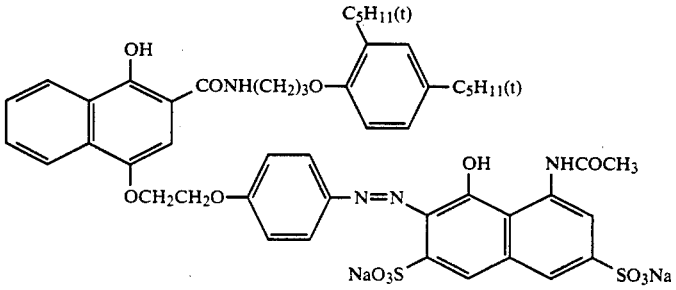

C-3

-continued
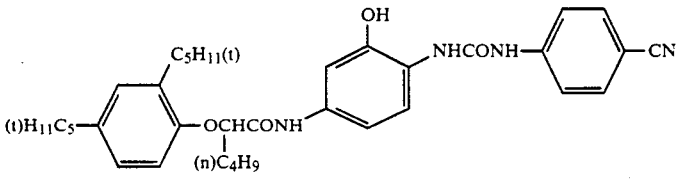
C-4
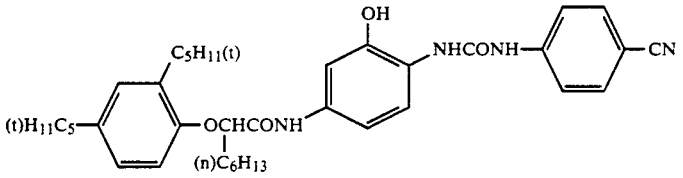
C-5
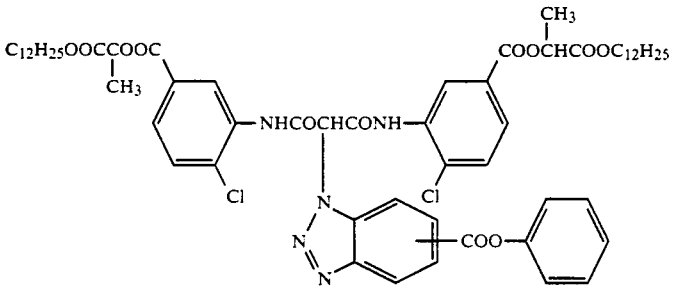
C-6
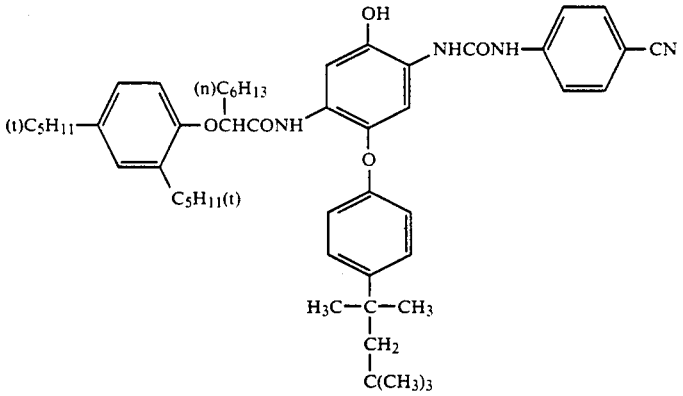
C-7
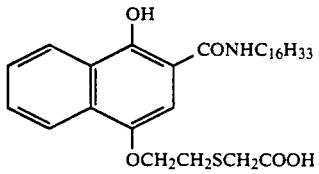
C-8
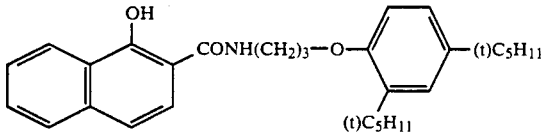
C-9

-continued
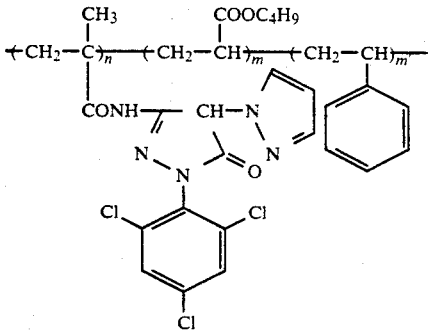
n = 55
m = 20
m' = 25
mol. wt about 20,000
C-10
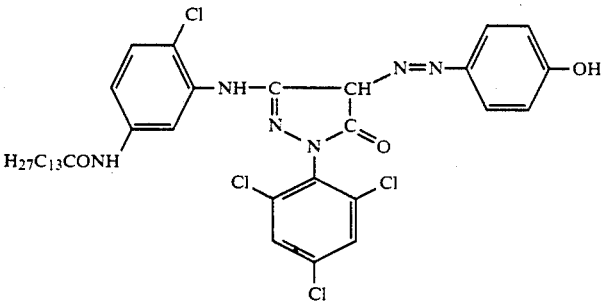
C-11
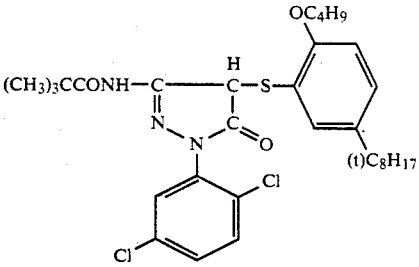
C-12
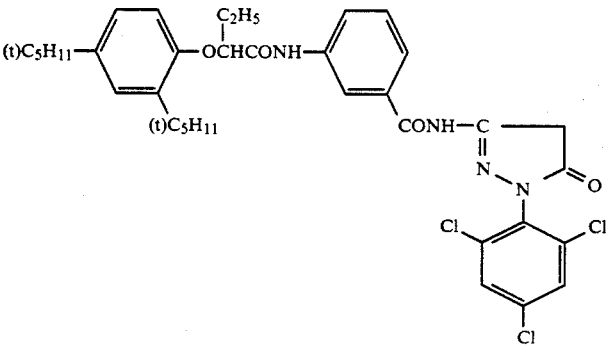
C-13

-continued
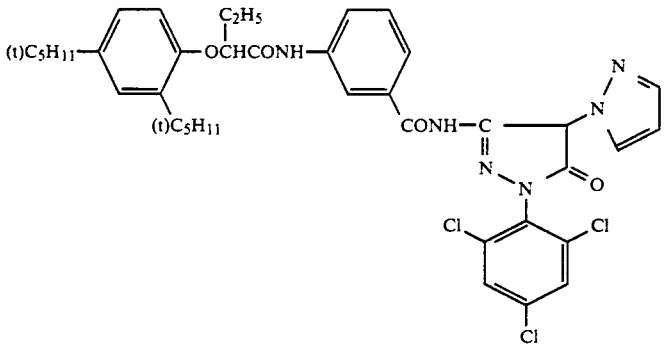
C-14
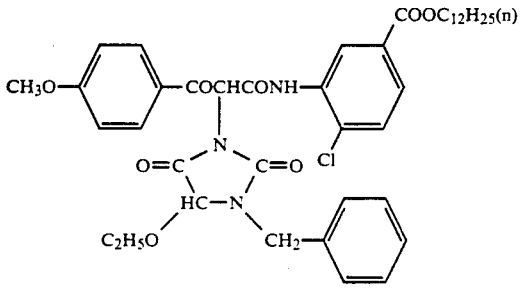
C-15
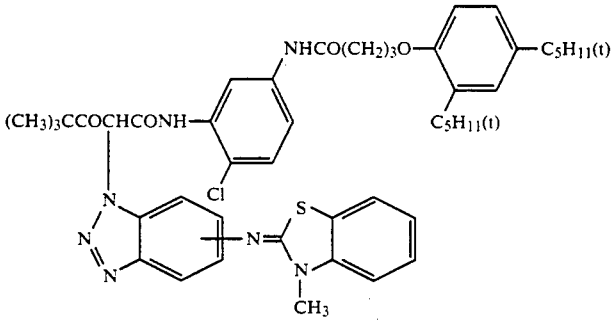
Cpd-A
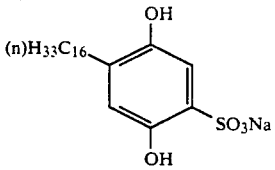
Cpd-B
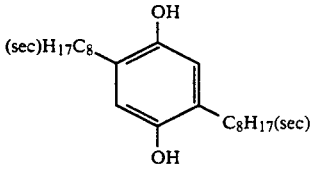
Cpd-C
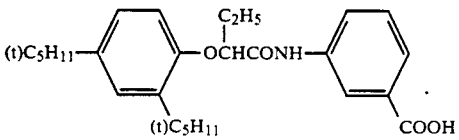
Sensitizing dye I -continued
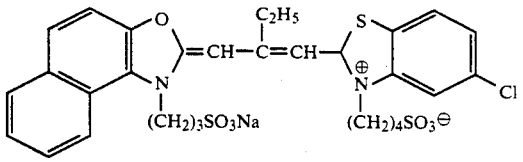
Sensitizing dye II
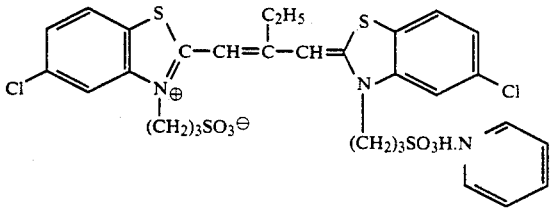
Sensitizing dye III
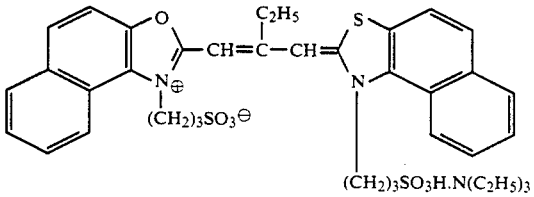
Sensitizing dye IV
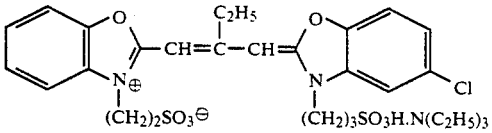
Sensitizing dye V
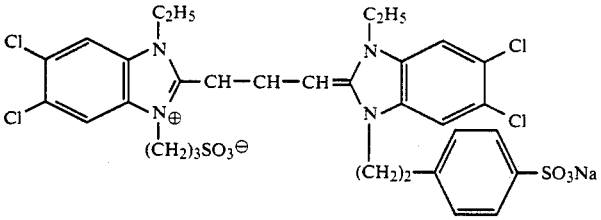
Sensitizing dye VI
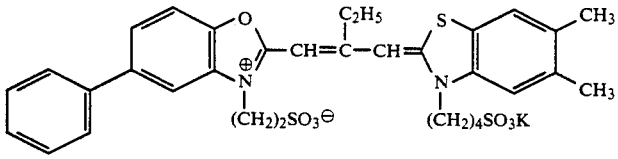
Sensitizing dye VII
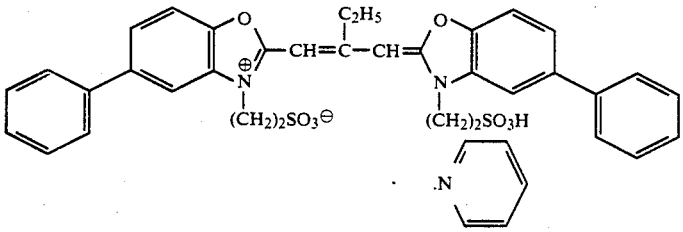
Sensitizing dye VIII -continued

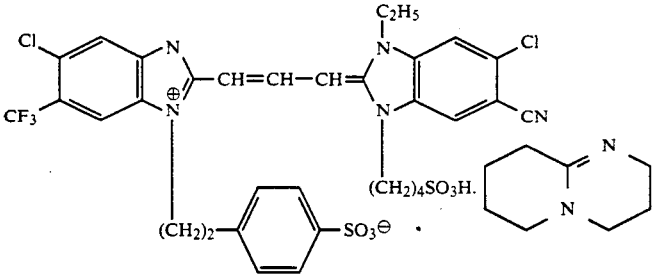

Sensitizing dye IX

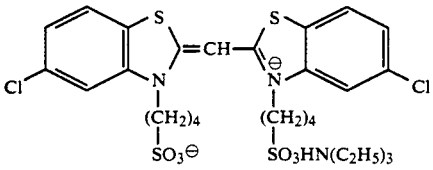

H-1

$CH_2{=}CH{-}SO_2{-}CH_2{-}CONH{-}CH_2$
$CH_2{=}CH{-}SO_2{-}CH_2{-}CONH{-}CH_2$

S-1

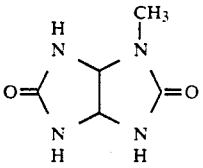

S-2

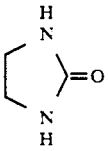

After exposure of the above-described color photographic photosensitive material 4-A, it was processed with an automatic developing machine by a method which will be described below until the cumulative amount of the replenished bleach-fixing solution became three times as much as the capacity of the mother liquor tank.

| Processing method | | | | |
|---|---|---|---|---|
| Step | Processing time | Processing temperature | Amount of replenisher | Tank capacity |
| Color development | 3 min 15 sec | 37.8° C. | 40 ml | 10 l |
| Bleach-fixing | 4 min 30 sec | 37.8° C. | see Table 3 | 15 l |
| Stabilization (1) | 30 sec - | 35.0° C. | counter current tube system (from (3) to (1)) | 5 l |
| Stabilization (2) | 30 sec | 35.0° C. | | 5 l |
| Stabilization (3) | 30 sec | 35.0° C. | See Table 3 | 5 l |
| Drying | 1 min 20 sec | 55.0° C. | | |

The brought-in amount was 2.0 ml/m (35 mm width).

The compositions of the processing solutions will be shown below.

pH of the bleach-fixing solution and the amount of the stabilizer solution replenished were changed as shown in Table 3.

| | Mother liquor (g) | Replenisher (g) |
|---|---|---|
| Color developer | | |
| diethylenetriaminepentaacetic acid | 5.0 | 6.0 |
| sodium sulfite | 4.0 | 4.4 |
| potassium carbonate | 30.0 | 37.0 |
| potassium bromide | 1.3 | 0.9 |
| potassium iodide | 1.2 mg | — |
| hydroxylamine sulfate | 2.0 | 2.8 |
| 4-[N-ethyl-N-(8-hydroxyethyl)-amino]-2-methylaniline sulfate | 4.7 | 5.3 |
| water | ad 1.0 l | ad 1.0 l |
| pH | 10.00 | 10.05 |
| Bleach-fixing solution | | |
| ferric ammonium ethylenediaminetetraacetate dihydrate | 100 | 150 |
| ammonium thiosulfate (70%) | 200 ml | 300 ml |
| sodium sulfite | 15 g | 20 g |
| ethylenediaminetetraacetic acid | 4.0 | 5.0 |
| ammonium bromide | 100.0 | 160.0 |
| ammonium nitrate | 30.0 | 50.0 |
| 2-mercapto-5-aminothiazole | 1.0 g | 1.5 g |

-continued

| | Mother liquor (g) | Replenisher (g) |
|---|---|---|
| acetic acid (98%) | 9.0 ml | 15.0 ml |
| water | ad 1.0 l | ad 1.0 l |
| pH (adjusted with aqueous ammonia or acetic acid) | see Table 3 | |
| Stabilizer for both mother liquid and replenisher | | |
| formalin (37%) | 1.2 ml | |
| 5-chloro-2-methyl-4-isothiazolin-3-one | 6.0 mg | |
| 2-methyl-4-isothiazolin-3-one | 3.0 mg | |
| surfactant $[C_{10}H_{21}—O—(CH_2CH_2O)—_{10}H]$ | 0.4 | |
| ethylene glycol | 1.0 l | |
| water | ad 1.0 | |
| pH | 5.0 to 7.0 | |

The stability of the solution and coloring rate of the cyan dye were determined in the same manner as that of Example to obtain the results shown in Table 3.

TABLE 3

| No. | Bleach-fixing solution (pH) Solution in tank | Replenisher | Running equilibrium solution | Amount of stabilizing solution added (ml/m) | Replenisher/Brought-in solution | Remarks | Stability Bleach-fixing solution | Stabilizing solution 1 | Coloring rate (%) |
|---|---|---|---|---|---|---|---|---|---|
| 1 | 3.0 | 3.5 | 3.2 | 30 | 15 | Comparative example | 4 | 1 | 65 |
| 2 | 4.5 | 4.0 | 4.3 | 30 | 15 | Present invention | 35 | 27 | 95 |
| 3 | 4.5 | 4.0 | 4.2 | 60 | 30 | Present invention | 34 | 28 | 96 |
| 4 | 4.5 | 4.3 | 4.3 | 120 | 60 | Comparative example | 35 | 29 | 73 |
| 5 | 6.0 | 5.5 | 6.0 | 30 | 15 | Comparative example | 17 | 5 | 97 |

According to the present invention, the solutions (Nos. 2 and 3) had a high stability and the cyan dye was scarcely converted into the leuco form.

EXAMPLE 5

Multi-layer photographic papers having the following layer structures were prepared by using a paper support laminated with polyethylene on both surfaces thereof. The couplers were varied. The coating solutions were prepared as follows:

Photographic paper 5-A

Preparation of coating solution for forming the first layer 27.2 ml of ethyl acetate and 7.7 ml (8.0 g) of a high-boiling solvent (Solv-1) were added to a mixture of 19.1 g of a yellow coupler (Y-21) and 4.4 g of a color image stabilizer (Cpd-1) to prepare a solution. The solution was dispersed in 185 ml of 10% aqueous gelatin solution containing 8 ml of 10% sodium dodecylbenzenesulfonate to prepare an emulsified dispersion. The dispersion was mixed with emulsions EM 7 and EM 8 to prepare a solution. The gelatin concentration was ajusted to obtain a composition which will be shown below. This was the coating solution for forming the first layer. The coating solutions for forming the second to the seventh solutions were prepared in the same manner as above.

Sodium salt of 1-hydroxy-3,5-dichloro-s-triazine was used as the hardener for gelatin in each layer. (Cpd-1) was used as the thickening agent.

Layer structure

The compositions of the respective layers are shown below. The numerals refer to the amount of the coating ($g/m^2$). The amount of the silver halide emulsion is given in terms of silver applied.

| | |
|---|---|
| Support | |
| paper laminated with polyethylene (the polyethylene layer adjacent to the first layer contained a white pigment ($TiO_2$) and bluing dye) | |
| The first layer (blue-sensitive layer) | |
| monodisperse silver chlorobromide emulsion spectrally sensitized with sensitizing dye (ExS-1) (EM-7) | 0.15 |
| monodisperse silver chlorobromide emulsion spectrally sensitized with sensitizing dye (ExS-1) (EM-8) | 0.15 |
| gelatin | 1.86 |
| yellow coupler (Y-21) | 0.82 |
| color image stabilizer (Cpd-2) | 0.19 |
| solvent (Solv-1) | 0.35 |
| The second layer (color mixing-inhibiting layer) | |
| gelatin | 0.99 |
| color mixing inhibitor (Cpd-3) | 0.08 |
| The third layer (green-sensitive layer) | |
| monodisperse silver chlorobromide emulsion spectrally sensitized with sensitizing dyes (ExS-2 and 3) (EM 9) | 0.12 |
| monodisperse silver chlorobromide emulsion spectrally sensitized with sensitizing dyes (ExS-2 and 3) (EM 10) | 0.24 |
| gelatin | 1.24 |
| magenta coupler (M-13) | 0.39 |
| color image stabilizer (Cpd-4) | 0.25 |
| color image stabilizer (Cpd-5) | 0.12 |
| solvent (Solv-2) | 0.25 |
| The fourth layer (U.V-absorbing layer) | |
| gelatin | 1.60 |
| U.V. absorber (Cpd-6/Cpd-7/Cpd-8 weight ratio = 3/2/6) | 0.70 |
| color mixing inhibitor (Cpd-9) | 0.05 |
| solvent (Solv-3) | 0.42 |
| The fifth layer (red-sensitive layer) | |
| monodisperse silver chlorobromide emulsion spectrally sensitized with sensitizing dyes (ExS-4 and 5) (EM 11) | 0.07 |
| monodisperse silver chlorobromide emulsion spectrally sensitized with sensitizing dyes (ExS-4 and 5) (EM 12) | 0.16 |

-continued

| | |
|---|---|
| gelatin | 0.92 |
| cyan coupler (ExC-1) | 1.46 |
| cyan coupler (ExC-2) | 1.84 |
| color image stabilizer (Cpd-7/Cpd-8/Cpd-10 weight ratio = 3/4/2) | 0.17 |
| disperse polymer (Cpd-11) | 0.14 |
| solvent (Solv-1) | 0.20 |
| The sixth layer (U.V. absorbing layer) | |
| gelatin | 0.54 |
| U.V. absorber (Cpd-6/Cpd-8/Cpd-10 weight ratio = 1/5/3) | 0.21 |
| solvent (Solv-4) | 0.08 |
| The seventh layer (protective layer) | |
| gelatin | 1.33 |
| acryl-modified copolymer of polyvinyl alcohol (degree of modification: 17%) | 0.17 |
| liquid parffin | 0.03 |

As irradiation-inhibiting dyes, Cpd-12 and Cpd-13 were used.

The layers further contained Alkanol XC (a product of Du Pont), sodium alkylbenzenesulfonates, succinic esters and Magefacx F-120 (a product of Dainippon Ink Co., Ltd.) as emulsifying/dispersing agents and coating aids. Cpd-14 and Cpd-15 were used as the stabilizers for the silver halides.

The details of the emulsions used were as follows:

| Emulsion | Shape | Grain diameter (μ) | Br content (mol %) | Coefficient of variation* |
|---|---|---|---|---|
| EM7 | Cube | 1.1 | 1.0 | 0.10 |
| EM8 | Cube | 0.8 | 1.0 | 0.10 |
| EM9 | Cube | 0.45 | 1.5 | 0.09 |
| EM10 | Cube | 0.34 | 1.5 | 0.09 |
| EM11 | Cube | 0.45 | 1.5 | 0.09 |
| EM12 | Cube | 0.34 | 1.6 | 0.10 |

*Coefficient of variation (grain size distribution) = Standard deviation / Average size The structural formulae of the compounds used are as follows:

(the same as Y-21)

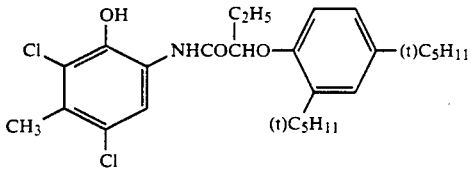

ExY-1 (the same as M-13)

ExM-1

ExC-1 (the same as C-14)

ExC-2

ExS-1

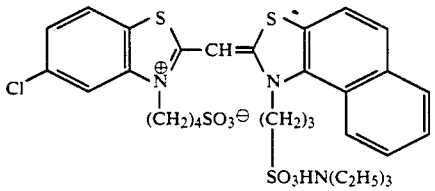

ExS-2

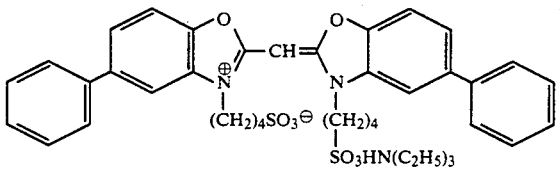

ExS-3

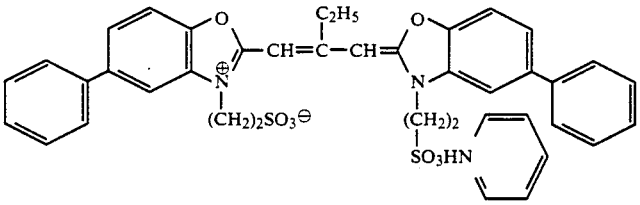

ExS-4

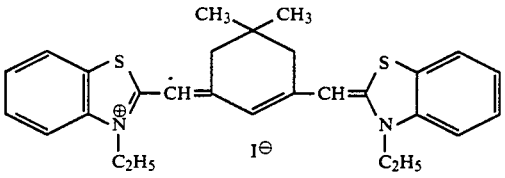

ExS-5

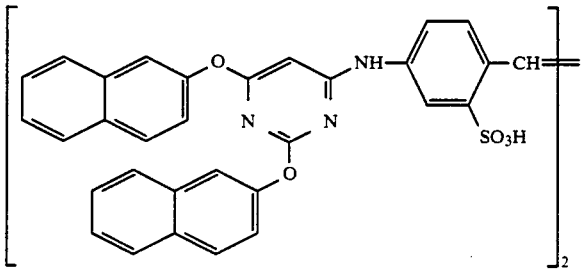

-continued
Cpd-1
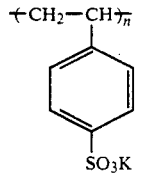
Cpd-2
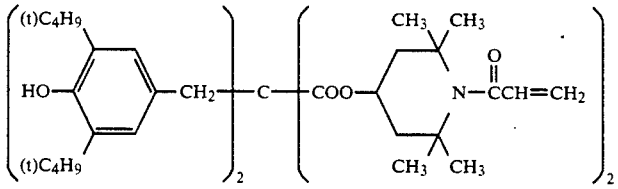
Cpd-3
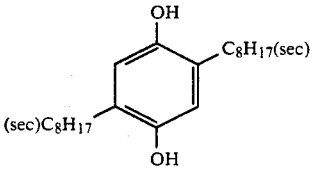
Cpd-4
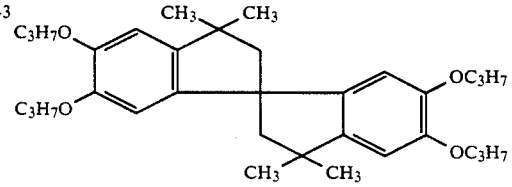
Cpd-5
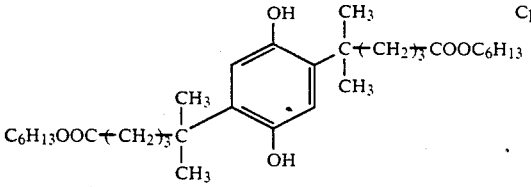
Cpd-6
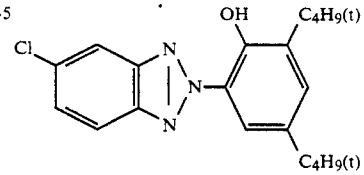
Cpd-7
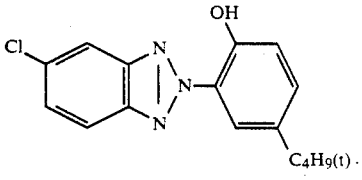
Cpd-8
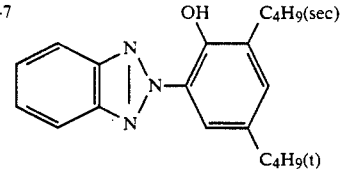
Cpd-9
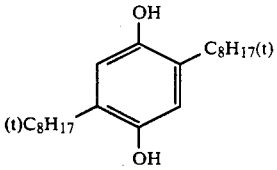
Cpd-10
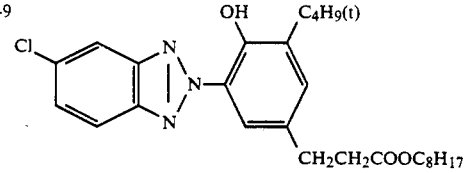
Cpd-11
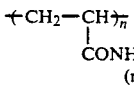
Cpd-12
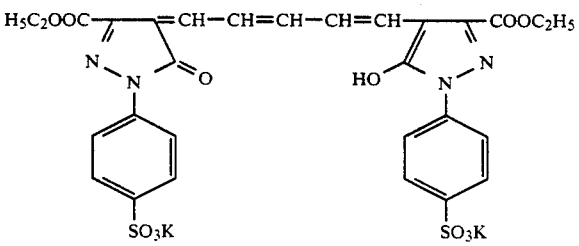

-continued

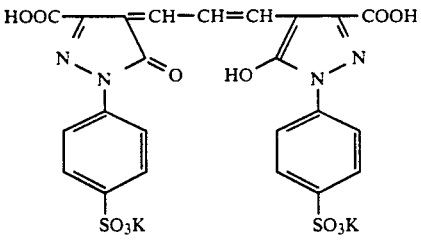

Cpd-13

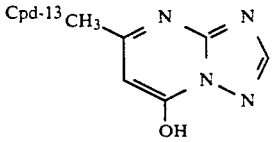

Cpd-14

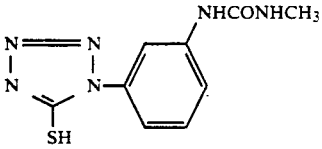

Cpd-15 dibutyl phthalate Solv-1 trioctyl phosphate Solv-2 trinonyl phosphate Solv-3 tricresyl phosphate solv-4

An alkali-treated gelatin having an isoelectric point of 5.0 was used in all cases. The sample will be referred to as Sample 5-A.

Samples 5-B, 5-C, 5-D and 5-E were prepared in the same manner as that of the preparation of the Sample 5-A except that the couplers were replaced with equimolar amounts of other couplers as shown in the following table.

| Sample | Yellow coupler | Magenta coupler | Cyan coupler |
|---|---|---|---|
| 5-A | Y-22 | M-13 | ExC-1 + C-14 (each 50 molar %) |
| 5-B | Y-3 | M-25 | C-2 + C-18 (each 50 molar %) |
| 5-C | Y-23 | M-26 | ExC-1 (100%) |
| 5-D | 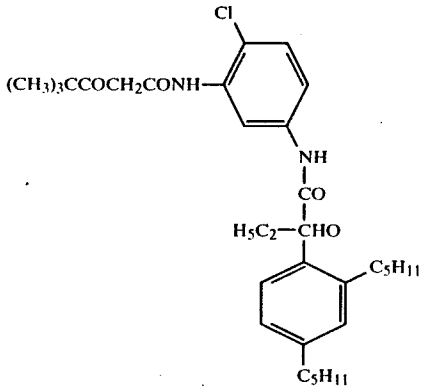 | 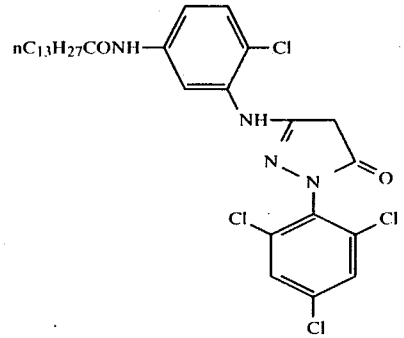 | 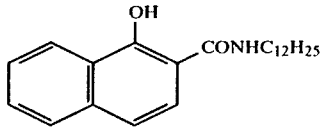 |
| 5-E | 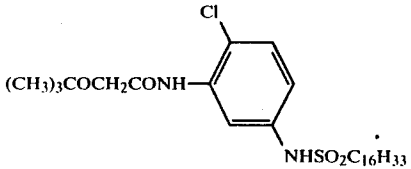 | 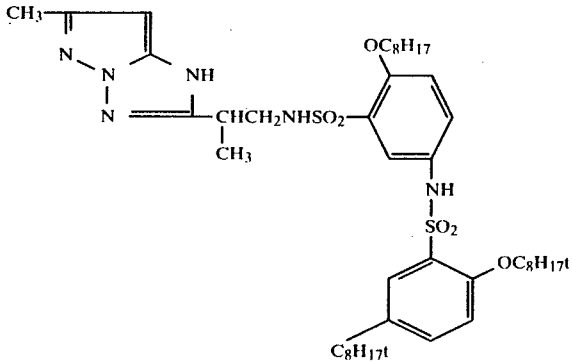 | 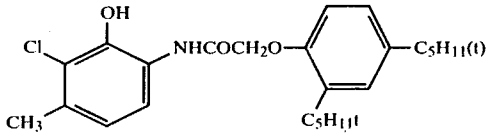 |

The Sample 5-A was subjected to an imagewise exposure and then a running test in which the amount of the stabilizing solution replenished was changed as shown in Table 4 was conducted.

The processing steps were as follows:

| Processing step | Temperature | Time | Replenished amount* | Tank capacity |
|---|---|---|---|---|
| Color development | 35° C. | 45 sec | 161 ml | 17 l |
| Bleach-fixing | 30 to 36° C. | 45 sec | 215 ml | 17 l |
| Stabilization (1) | 30 to 37° C. | 20 sec | — | 10 l |
| Stabilization (2) | 30 to 37° C. | 20 sec | — | 10 l |
| Stabilization (3) | 30 to 37° C. | 20 sec | — | 10 l |
| Stabilization (4) | 30 to 37° C. | 30 sec | See Table 4 | 10 l |
| Drying | 70 to 85° C. | 60 sec | | |

* per $m^2$ of the photosensitive material [counter current system in four stabilization tanks: (4) → (1)]
The quantity of the stabilizing solution brought therein from the preceding bath was 30 ml/$m^2$.

The processing solutions had the following compositions:

| | Tank | Replenisher |
|---|---|---|
| Color developer | | |
| water | 800 ml | 800 ml |
| ethylenediaminetetraacetic acid | 2.0 g | 2.0 g |
| 5,6-dihydroxybenzene-1,2,4-trisulfonic acid | 0.3 g | 0.3 g |
| triethanolamine | 8.0 g | 8.0 g |
| sodium chloride | 1.4 g | — |
| potassium carbonate | 25 g | 25 g |
| N-ethyl-N-(β-methanesulfonamidoethyl)-3-methyl-4-aminoaniline sulfate | 5.0 g | 7.0 g |
| diethylhydroxylamine | 4.2 g | 6.0 g |
| fluorescent brightening agent (UVITEX CK; a product of Ciba Co.) | 2.0 g | 2.5 g |
| water | ad 1000 ml | ad 1000 ml |
| pH (25° C.) | 10.05 | 10.45 |
| Bleach-fixing solution | | |
| (The tank solution had the same composition as that of the replenisher) | | |
| water | 400 ml | |
| ammonium thiosulfate (70%) | 100 ml | |
| sodium nitrite | 17 g | |
| iron (III) ammonium ethylenediaminetetraacetate | 55 g | |
| disodium ethylenediaminetetraacetate | 5 g | |

-continued

| | Tank | Replenisher |
|---|---|---|
| glacial acetic acid | 10 g | |
| ammonium bromide | 30 g | |
| water | ad 1000 ml | |
| pH (25° C.) | 4.0 | |
| Stabilizing solution | | |
| (The tank solution had the same composition as that of the replenisher) | | |
| aqueous ammonia (27%) | 2.0 ml | |
| formalin (37%) | 0.1 g | |
| formalin/sulfurous acid adduct | 0.7 g | |
| 5-chloro-2-methyl-4-isothiazolin-3-one | 0.02 g | |
| 2-methyl-4-isothiazolin-3-one | 0.01 g | |
| copper sulfate | 0.005 g | |
| water | ad 1000 ml | |
| pH (25° C.) | 4.0 | |

The bleach-fixing running solutions prepared as described above had a pH of 4.4 to 4.6 which was within the scope of the present invention. Samples 5-A, 5-B, 5-C, 5-D and 5-E were subjected to wedge exposure and processed with the running solutions. The coloring rate of cyan and increase of stain with time were determined to obtain the results shown in Table 4.

TABLE 4

| No. | Amount of stabilizing solution replenished ml/$m^2$ | Supplied/brought-in | Photosensitive material | Remarks | Coloring rate of cyan (%) | $\Delta D_{min}$ B | G | R |
|---|---|---|---|---|---|---|---|---|
| 1 | 60 | 2 | 5-A | Comparative | 97 | +0.27 | +0.15 | +0.11 |
| 2 | | | B | example | 98 | +0.28 | +0.15 | +0.13 |
| 3 | | | C | | 92 | +0.28 | +0.16 | +0.12 |
| 4 | | | D | | 92 | +0.30 | +0.10 | +0.08 |
| 5 | | | E | | 90 | +0.35 | +0.12 | +0.07 |
| 6 | 240 | 8 | A | Present | 98 | +0.11 | +0.05 | +0.04 |
| 7 | | | B | invention | 99 | +0.10 | +0.04 | +0.04 |
| 8 | | | C | | 93 | +0.10 | +0.04 | +0.04 |
| 9 | | | D | | 92 | +0.15 | +0.07 | +0.05 |
| 10 | | | E | | 91 | +0.16 | +0.08 | +0.06 |
| 11 | 1800 | 60 | A | Comparative | 84 | +0.11 | +0.05 | +0.04 |
| 12 | | | B | example | 84 | +0.11 | +0.05 | +0.04 |
| 13 | | | C | | 80 | +0.10 | +0.05 | +0.04 |
| 14 | | | D | | 80 | +0.16 | +0.08 | +0.05 |
| 15 | | | E | | 80 | +0.16 | +0.08 | +0.05 |

According to the present invention, a high coloring rate of cyan and an excellent image stability were obtained. Particularly when a preferred coupler (5-A, 5-B or 5-C) was used, more excellent results were obtained.

EXAMPLE 6

The same procedure as that of Example 5 was repeated except that the couplers listed in Table 5 were used as a yellow coupler, a magenta coupler and a cyan coupler, whereby multi-layer photographic papers 6-A, 6-B, 6-C, 6-D, 6-E and 6-F were obtained.

TABLE 5

| Sample | Yellow coupler | Magenta coupler | Cyan coupler |
|---|---|---|---|
| 6-A | Y-20 | M-30 | C-2 |
| 6-B | Y-23 | M-21 | C-2 |
| 6-C | Y-25 | M-23 | C-2 |
| 6-D | Y-21 | M-13 | C-2 |
| 6-E | Y-22 | M-21 | C-2 |
| 6-F | Y-24 | M-28 | C-2 |

The resulting samples were subjected to an imagewise exposure and then processing continuously by the following steps until the replenished amount of the color developer reached to a volume twice of a tank capacity. A reorganized machine of a printer processor pp 6600 manufactured by Fuji Photo Film K.K. was used for the above processing.

| Processing step | Temperature | Time | Replenished amount* | Tank capacity |
|---|---|---|---|---|
| Color development | 37° C. | 45 sec | 70 ml | 10 l |
| Bleach-fixing | 35° C. | 45 sec | 100 ml | 10 l |
| Washing (1) | 35° C. | 30 sec | — | 5 l |
| Washing (2) | 35° C. | 30 sec | — | 5 l |
| Washing (3) | 35° C. | 30 sec | 200 ml | 5 l |
| Drying | 80° C. | 60 sec | — | — |

*per $m^2$ of the photosensitive material [counter current system in four washing tanks: (3) → (1)]

The processing solutions had the following compositions (Two types of the bleach-fixing solution (A and B) were used):

| | Tank | Replenisher |
|---|---|---|
| Color developer | | |
| water | 800 ml | 800 ml |
| ethylenediamine-N,N,N,N-tetramethylenephosphonic acid | 3.0 g | 6.0 g |
| N,N-bis(carboxy methyl)hydrazine | 4.0 g | 10.0 g |
| sodium chloride | 4.2 g | — |
| potassium carbonate | 25 g | 25 g |
| N-ethyl-N-(β-methanesulfonamidoethyl)-3-methyl-4-aminoaniline sulfate | 5.0 g | 11.0 g |
| triethanolamine | 10.0 g | 10.0 g |
| fluorescent brightening agent 4,4'-diaminostylbene type; a product of Sumitomo Chemical Co. | 2.0 g | 2.5 g |
| sodium sulfite | — | 0.2 g |
| water | ad 1000 ml | ad 1000 ml |
| pH (25° C.) | 10.05 | 10.70 |
| Bleach-fixing solution A | | |
| (The tank solution had the same composition as that of the replenisher) | | |
| water | 400 ml | |
| ammonium thiosulfate (70%) | 150 ml | |
| sodium sulfite | 30 g | |
| iron (III) ammonium ethylenediaminetetraacetate | 80 g | |
| disodium ethylenediaminetetraacetate | 5 g | |
| glacial acetic acid | 9 g | |
| ammonium bromide | 40 g | |
| water | ad 1000 ml | |
| pH (25° C.) | 4.5 | |
| Bleach-fixing solution B had the same composition as that of the bleach-fixing solution A except that pH thereof was 5.5 | | |
| Rinsing solution | | |
| (The tank solution had the same composition as that of the replenisher) | | |
| Ion exchanged water (Ca: 3 ppm or less, Mg: 3 ppm or less) | | |

Samples 6-A to 6-F not subjected to an exposure were processed with the resulting equilibrium running solution and then kept under the condition of 60° C./70% RH for 1 month. The increases of the minimum density of yellow and magenta were measured (Table 6).

TABLE 6

| No. | Sample | Bleach-fixing solution | Final pH of bleach-fixing soln. | Remarks | $\Delta D_{min}$ B | $\Delta D_{min}$ G |
|---|---|---|---|---|---|---|
| 1 | 6-A | A | 5.2 | Present invention | +0.17 | +0.16 |
| 2 | 6-B | A | 5.3 | | +0.16 | +0.13 |
| 3 | 6-C | A | 5.2 | | +0.16 | +0.13 |
| 4 | 6-D | A | 5.2 | | +0.14 | +0.15 |
| 5 | 6-E | A | 5.3 | | +0.10 | +0.09 |
| 6 | 6-F | A | 5.3 | | +0.09 | +0.09 |
| 7 | 6-A | B | 6.3 | Comparative example | +0.24 | +0.21 |
| 8 | 6-B | B | 6.4 | | +0.23 | +0.23 |
| 9 | 6-C | B | 6.4 | | +0.23 | +0.24 |
| 10 | 6-D | B | 6.3 | | +0.22 | +0.21 |
| 11 | 6-E | B | 6.3 | | +0.24 | +0.21 |
| 12 | 6-F | B | 6.3 | | +0.25 | +0.25 |

According to the present invention, the yellow and magenta stain causing after processing were inhibited. Particularly when a preferred yellow coupler was used (Sample Nos. 4, 5 and 6), the yellow stain was remarkably inhibited and when a preferred magenta coupler was used (Sample Nos. 2, 3, 5 and 6), the magenta stain was remarkably inhibited. Further when preferred yellow and magenta couplers were used (Sample Nos. 5 and 6), increases of yellow and magenta stain were advantageously controlled.

What is claimed is:

1. A method for processing a silver halide color photographic photosensitive material which comprises subjecting an imagewise exposed silver halide color photographic photosensitive material to a color development process followed by a bleach-fixing process and a water washing and/or stabilization process, the method further comprising that (i) the bleach-fixing process occurs immediately after the color development process, (ii) the pH of the bleach-fixing solution ranges from 4.0 to 5.0, (iii) the time required for the bleach-fixing process is 30 to 60 seconds, and the time for the water washing and/or the stabilization is 30 seconds to 90 seconds, and (iv) the amount of replenished liquid for washing water and/or stabilization solution is 3 to 50 times the volume of liquid carried over from the bath preceding the water washing and/or the stabilization bath.

2. A method for processing a photosensitive material according to claim 1 wherein the silver halide color photographic photosensitive material contains at least one 2-equivalent coupler.

3. A method for processing a photosensitive material according to claim 1 wherein the amount of replenished liquid for washing water and/or stabilization solution is 5 to 30 times the volume of liquid carried over from the bath preceding the water washing and/or the stabilization bath.

4. A method for processing a photosensitive material according to claim 1 wherein the silver halide color photographic photosensitive material contains at least one cyan coupler represented by the following formulas (I) and (II):

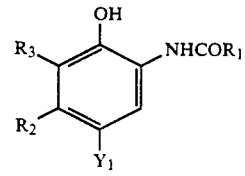

(I)

-continued

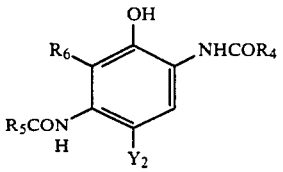

(II)

wherein $R_1$, $R_4$ and $R_5$ each represent an aliphatic group, aromatic group, heterocyclic group, aromatic amino group or heterocyclic amino group; $R_2$ represents an aliphatic group having 2 or more carbon atoms; $R_3$ and $R_6$ each represent a hydrogen atom, halogen atom, aliphatic group, aliphatic oxy group or acylamino group; $R_2$ and $R_3$, or $R_5$ and $R_6$ may form bonded together to form a 5-, 6- or 7-membered ring; $Y_1$ and $Y_2$ each represent a halogen atom or a group split off in the coupling reaction with the developing agent; and $R_1$, $R_2$, $R_3$ or $Y_1$ and $R_4$, $R_5$, $R_6$ or $Y_2$ may form a dimer or a polymer.

5. A method for processing a photosensitive material according to claim 1 wherein the silver halide color photographic photosensitive material contains at least one magenta coupler represented by the following formulas (III) and (IV):

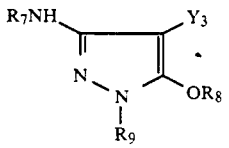

(III)

-continued

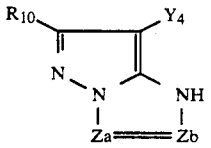

(IV)

wherein $R_7$ and $R_9$ each represent a substituted or unsubstituted phenyl group; $R_8$ represents a hydrogen atom, aliphatic or aromatic acyl group, or aliphatic or aromatic sulfonyl group; $R_{10}$ represents a hydrogen atom or substituent; Za and Zb each represent a methine, substituted methine or =N—; $Y_3$ and $Y_4$ each represent a halogen atom or a group split off in the coupling reaction with the developing agent; and $R_7$, $R_8$, $R_9$ or $Y_3$ and $R_{10}$, Za, Zb or $Y_4$ may form a dimer or a polymer.

6. A method for processing a photosensitive material according to claim 1 wherein the silver halide color photographic photosensitive material contains at least one yellow coupler represented by the following formula (V):

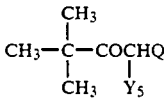

(V)

wherein Q represents a substituted or unsubstituted N-phenylcarbamoyl group; $Y_5$ represents a halogen atom or a group split off in the coupling reaction with the developing agent; and Q or $Y_5$ may form a dimer or a polymer.

* * * * *